US008136299B2

(12) United States Patent
Inage

(10) Patent No.: US 8,136,299 B2
(45) Date of Patent: Mar. 20, 2012

(54) SLIDING DOOR OPENING/CLOSING DEVICE FOR VEHICLE

(75) Inventor: Akio Inage, Mie (JP)

(73) Assignee: Fuji Electric Systems Co., Ltd., Tokyo (JP)

( * ) Notice: Subject to any disclaimer, the term of this patent is extended or adjusted under 35 U.S.C. 154(b) by 247 days.

(21) Appl. No.: 12/656,339

(22) Filed: Jan. 26, 2010

(65) Prior Publication Data

US 2010/0188177 A1 Jul. 29, 2010

(30) Foreign Application Priority Data

Jan. 27, 2009 (JP) ..... 2009-014995

(51) Int. Cl.
*E05C 7/04* (2006.01)

(52) U.S. Cl. ..... 49/118; 49/116; 49/279; 292/251.5

(58) Field of Classification Search ..... 49/116, 49/118, 122, 279, 280; 105/332, 333, 339; 292/251.5, 8, 32, 137, 162, 138, 144, 145, 292/146

See application file for complete search history.

(56) References Cited

U.S. PATENT DOCUMENTS 4,142,326 A * 3/1979 Schmitz ..... 49/118
4,934,488 A * 6/1990 Umemura ..... 187/335
5,246,089 A * 9/1993 Husmann et al. ..... 187/319
5,758,453 A * 6/1998 Inage ..... 49/118
6,009,668 A * 1/2000 Reddy ..... 49/280
6,094,867 A * 8/2000 Reddy ..... 49/280
6,863,001 B2 * 3/2005 Inage ..... 105/341
6,941,701 B2 * 9/2005 Inage ..... 49/449
2002/0194784 A1 * 12/2002 Stojc et al. ..... 49/118
2003/0126797 A1 * 7/2003 Inage ..... 49/118
2006/0174540 A1 * 8/2006 Oberleitner ..... 49/118
2009/0230704 A1 * 9/2009 Goddard et al. ..... 292/251.5

FOREIGN PATENT DOCUMENTS

JP 2000-142392 A 5/2000

* cited by examiner

*Primary Examiner* — Jerry Redman
*Assistant Examiner* — Justin Rephann
(74) *Attorney, Agent, or Firm* — Rabin & Berdo, P.C.

(57) ABSTRACT

The present invention provides a sliding door opening/closing device for a vehicle that applies a sufficient opening/closing drive force to the left and right sliding doors and reduces a force necessary to lock and unlock the latch, despite a simple configuration of the device, and that facilitates the manufacturing process, improves operability and safety, and reduces noise. A lock device, against both sides of which locking portions abut, rotates a columnar permanent magnet so as to form magnetic locking circuits and fixes the locking portions by magnetic forces of the locking magnetic circuits. The rotational operation of the columnar permanent magnet is converted into the downward operation of a latch, and the lowered latch restrains the locking portions with respect to the lock device.

13 Claims, 20 Drawing Sheets

SLIDING DOOR OPENING/CLOSING DEVICE FOR VEHICLE

This application claim priority to Japanese Patent Application 2009-014995, filed Jan. 27, 2009, the entirety of which is incorporated herein by reference.

BACKGROUND OF THE INVENTION

1. Field of the Invention

The present invention relates to a sliding door opening/closing device for a vehicle that serves to open and close a sliding door of a vehicle.

2. Description of the Related Art

The related art of sliding door opening/closing devices for vehicles is disclosed, for example, in Japanese Patent Application Laid-open No. 2000-142392 (JP-A-2000-142392), the invention being titled "Sliding Door Opening/Closing Device for Vehicle". The sliding door opening/closing device for a vehicle disclosed in JP-A-2000-142392 is provided with a door lock device that locks and unlocks the sliding door in response to opening and closing of the sliding door. This door lock device locks the door so that it cannot be opened or closed, by dropping a latch into a lock hole. This door lock device is configured to lift the latch with a wire device and makes it possible to unlock the door by manually operating a handle device.

In the conventional sliding door opening/closing device for a vehicle, the latch has to be lowered after the latch has been correctly positioned above the lock hole, but this positioning is not easy to perform, as described hereinbelow.

A door edge rubber is provided at the left and right sliding doors as a measure against door clamping, and when the door is closed, the door edge rubber is compressed and deformed, thereby eliminating a gap between the sliding doors. However, a problem arising in a case where the crushing amount of the door edge rubber is large when the door is closed is that a resistance force applied to the sliding door increases, the latch shifts from a position above the lock hole, and locking with the latch is impossible.

Vibration preventing parts that have soundproofing, windstopping, and vibration damping functions are provided to abut against the sliding door when the vehicle is travelling (that is, when the door is closed), and a problem arising when these vibration preventing parts apply a force that exceeds a supposed value when the door is closed is that a resistance force applied to the sliding door increases, the latch shifts from a position above the lock hole, and locking with the latch is impossible.

Conversely, where the crushing amount of the door edge rubber is small, a resistance force applied to the sliding door is small. Furthermore, when the vibration preventing parts apply a force that is less than a supposed value when the door is closed, a resistance force applied to the sliding door is also small. The problem arising in these cases is that the resistance force falls within the specified range and the latch is closed even when a specified obstacle is squeezed by the sliding doors, and the sliding door does not comply with a door clamping test.

Because problems arise both in the case where the resistance force applied to the door is small and in the case where the force is large, as described above, this force has to be adjusted to fall in a predetermined range. The problem is, however, that the resistance force is not easy to adjust from both sides of the range, while correctly positioning the latch above the lock hole.

A structure can be used in which a gap is provided between the door edge rubbers at the left and right sides to facilitate the adjustment operation in order to satisfy the requirements placed on both the locking operation and the specified accuracy of door clamping detection, but with the door edge rubber of a shape protruding to the left and right, water and wind penetrate from the gap and noise is generated, thereby making it difficult to follow this approach.

Because the conventional door lock device uses a system such that the latch is lowered by spring pressure and the door lock device is locked by using an insertion force created by the inertia force of the doors that are shut at a certain door closing speed, the sound of the dropping part and the sound of collision are loud.

Because a force exceeding a large door counterforce that is applied to the latch in addition to the spring pressure pulling the latch has to be applied when the conventional door lock device is locked, a metal noise sound is loud.

A counterforce from the door edge rubber that is compressed when the door is closed is applied to the sliding door, a large door counterforce is applied to the latch in the lock device during locking, and the latch is difficult to move. The resultant problem is that where the handle is operated in a case of emergency in a state with such a large door counterforce, the outer wire is sometimes contracted, the inner wire is not drawn relative thereto, and emergency unlocking cannot be performed.

SUMMARY OF THE INVENTION

With the foregoing in view, in one aspect of the present invention a sliding door opening/closing device for a vehicle is configured to apply a sufficient opening/closing drive force to the left and right sliding doors and to reduce a force necessary to lock and unlock the latch, despite a simple configuration of the device, and that facilitates the manufacturing process, improves operability and safety, and reduces noise.

The sliding door opening/closing device for a vehicle in accordance with the present invention is described below.

The sliding door opening/closing device for a vehicle is provided with a magnetic lock device in which a columnar permanent magnet is rotatably supported and also provided with a latch lifting lock device comprising a latch and a conversion unit that converts a rotation operation of the columnar permanent magnet of the magnetic lock device into a lifting operation of the latch and vice versa. In such a sliding door opening/closing device for a vehicle, in an unlocked state in which the two sliding doors are opened and the two locking portions are separated from both sides of the magnetic lock device, the magnetic lock device rotates and fixes the columnar permanent magnet so as to form therein a magnetic circuit for unlocking, and the latch lifting lock device fixes the latch in a lifted position in response to the fixing of the columnar permanent magnet. Further, in a locked state in which the two sliding doors are closed and the two locking portions abut against both sides of the magnetic lock device, the magnetic lock device attracts and fixes the two locking portions by a magnetic force, while rotating and fixing the columnar permanent magnet, so as to form therein a magnetic circuit for locking together with the two locking portions that abut against both sides, and the latch lifting lock device, while fixing the latch in a lowered position in response to the fixing of the columnar permanent magnet, restrains the two locking portions to prevent them from separating from the magnetic lock device, using the lowered latch.

The locking portions are strongly attracted and fixed by magnetic forces. Further, the locking portions are reliably restrained to prevent them from being moved by the latch.

Further, in an unlocked state in which the two sliding doors are opened and the two locking portions are separated from both sides of the magnetic lock device, the columnar permanent magnet of the magnetic lock device is applied with an initial rotation force that causes rotation in one direction, which is obtained by converting a lowering force created by the own weight of the lifted latch by the conversion unit. As a result, the columnar permanent magnet provides a force that causes rotation in the direction of lowering the latch.

Further, the columnar permanent magnet of the magnetic lock device is fixed by a fixing force that exceeds the initial rotation force and is applied by the magnetic circuit for unlocking formed inside the columnar permanent magnet. As a result, the latch lifting lock device maintains the lifted position of the latch. Therefore, in the unlocked state, the latch is fixed so as to maintain the lifted position, regardless of the initial rotation force.

Further, when a transition is made from an unlocked state to a locked state in which the two sliding doors are closed and the two locking portions abut against both sides of the magnetic lock device, the magnetic lock device rotates the columnar permanent magnet while applying a rotation force thereto so as to form therein a magnetic circuit for locking together with the two locking portions that abut against both sides, and attracts and fixes the two locking portions by a magnetic force at the same time of the formation of the magnetic circuit for locking, and the latch lifting lock device converts the rotation force of the columnar permanent magnet into the lowering force of the latch, and restrains the two locking portions and the magnetic lock device by the lowered latch. Therefore, during locking, the rotation of the columnar permanent magnet applies the magnetic forces and lowers the latch.

In the latch lifting lock device, an actuator lifts the latch and cancels the restraint created by the latch, the lifting operation of the latch is converted into a rotation operation of the columnar permanent magnet, the magnetic circuit for locking is opened, and the restraint of the two locking portions created by the magnetic attraction is canceled. Because the latch does not apply a strong force, the latch can be lifted even by a small force of a small actuator.

Further, the latch lifting lock device includes a wire device that performs an operation of lifting the latch, and the wire device lifts the latch and cancels the restraint created by the latch, the lifting operation of the latch is converted into a rotation operation of the columnar permanent magnet, the magnetic circuit for locking is opened, and the restraint of the two locking portions created by the magnetic attraction is canceled. Because the latch does not apply a strong force, the latch can be lifted even by a small force of a small actuator.

The wire device of the latch lifting lock device further includes a handle device that moves the inner wire of the wire device, and the inner wire is moved by a handle operation of the handle device. In case of emergency, the latch can be released easily and reliably by manual operation. Further, because a small force is sufficient, the outer wire or inner wire is not deformed.

Where the inner wire is fixed by a stopper so as to prevent the inner wire from moving, the lowering of the latch by the latch lifting lock device and the rotation of the columnar permanent magnet of the magnetic lock device that accompanies this lowering are prevented. As a result, the formation of a magnetic circuit for locking is prevented. Therefore, as long as fixing is performed with the stopper in the lifted position of the latch, the two sliding doors can be opened and closed manually.

When the restraint of the latch is canceled by operating the handle device, the lifted position of the latch is held by the magnetic circuit for unlocking, and upon closing the two sliding doors manually, a magnetic circuit for locking is formed and locking is performed.

The conversion unit of the latch lifting lock device includes a pinion attached so as to be coaxial with a rotation shaft of the columnar permanent magnet and a rack attached so as to mesh with the pinion and extend along the lifting direction of the latch. The conversion unit therefore has a simple structure.

In the magnetic lock device, when the two locking portions are withdrawn from the magnetic circuit mechanism, a magnetic circuit for unlocking is formed by the columnar permanent magnet and the upper iron yoke, and a magnetic circuit for unlocking is formed by the columnar permanent magnet and the lower iron yoke, to stop the rotation of the columnar permanent magnet and fix the latch.

When the two locking portions abut against the magnetic circuit mechanism, the columnar permanent magnet is rotated, magnetic circuits for locking are formed by the columnar permanent magnet, the upper and lower iron yokes, and the two locking portions, and the two locking portions are attracted and fixed by a magnetic force.

With such a magnetic lock device, it is possible to form a magnetic circuit for unlocking and magnetic circuit for locking that have a simple configuration.

The opening/closing drive device may have a configuration in which the linear motor supplies an opening/closing drive force to one of the sliding door drive racks, supplies the opening/closing drive to one sliding door, and rotates the sliding door drive pinion, and the other sliding door drive rack supplies an opening/closing drive to the other sliding door via the sliding door drive pinion.

The opening/closing drive device may have a configuration in which the sliding door drive motor rotationally drives the pinion, an opening/closing drive force is supplied to one sliding door drive rack and the opening/closing drive force is supplied to one sliding door, and the other sliding door drive rack supplies an opening/closing drive force to the other sliding door.

Summarizing, the present invention can provide a sliding door opening/closing device for a vehicle that is configured to apply a sufficient opening/closing drive force to the left and right sliding doors and reduce a force necessary to lock and unlock the latch, despite a simple configuration of the device, and that facilitates the manufacturing process, improves operability and safety, and reduces noise.

DESCRIPTION OF THE PREFERRED EMBODIMENTS

Figure 1:
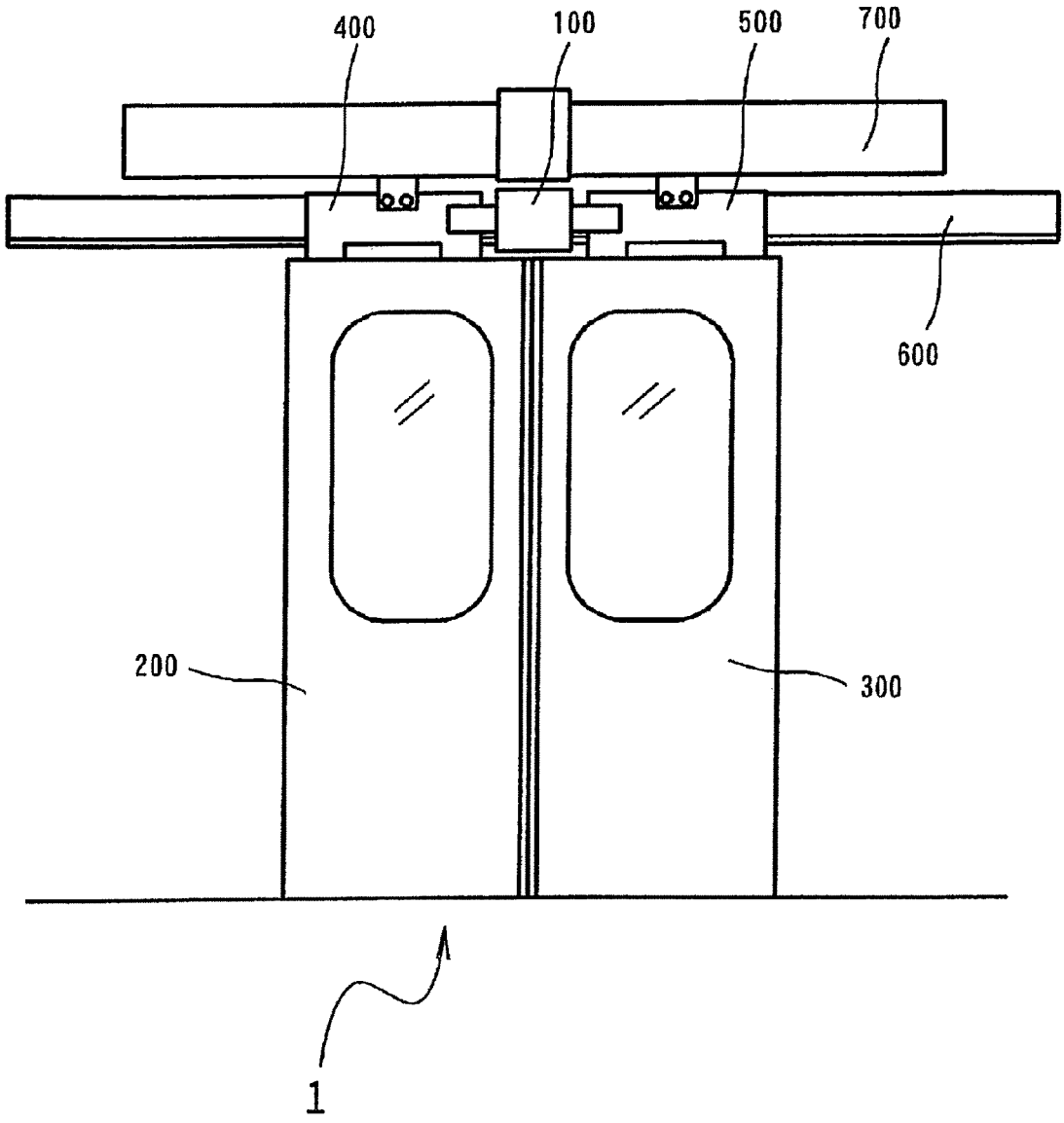
FIG. 1 is a structural diagram illustrating the configuration of the sliding door opening/closing device for a vehicle of an embodiment of the present invention.

The embodiments of the present invention will be described below with reference to the appended drawings. The entire structure of the sliding door opening/closing device 1 for a vehicle will be in initially explained with reference to FIGS. 1, 2, 3, and 4. As shown in FIG. 1, the sliding door opening/closing device 1 for a vehicle is provided at least with a lock device 100, a pair of left and right sliding doors 200, 300, a rail moving bodies 400, 500, a sliding door rail 600, and an opening/closing drive device 700.

The lock device 100 has a function of locking so as to prevent the pair of left and right sliding doors 200, 300 from opening when the pair of left and right sliding doors 200, 300 have been closed. The lock device 100 is generally composed of a magnetic lock device and a latch lifting lock device that will be described below in greater detail.

The sliding doors 200, 300 open and close the entrance/exit port of a railroad train by moving in the mutually opposite direction.

The sliding door 200 is suspended from the rail moving body 400. The sliding door 300 is suspended from the rail moving body 500. Door edge rubber 201, 301 is provided at the sliding doors 200, 300, respectively (see FIG. 3), and is compressed when the doors are closed, thereby eliminating the gap between the doors.

The rail moving bodies 400, 500 have door wheels, rollers, or slide rails and are configured to enable smooth movement of the doors along the sliding door rail 600 provided at the vehicle body. The sliding doors 200, 300 also smoothly move along the sliding door rail 600. The lock device 100 is positioned between the rail moving bodies 400, 500. These rail moving body 400, lock device 100, and rail moving body 500 are disposed side by side along the longitudinal direction of the sliding door rail 600.

Figure 2:
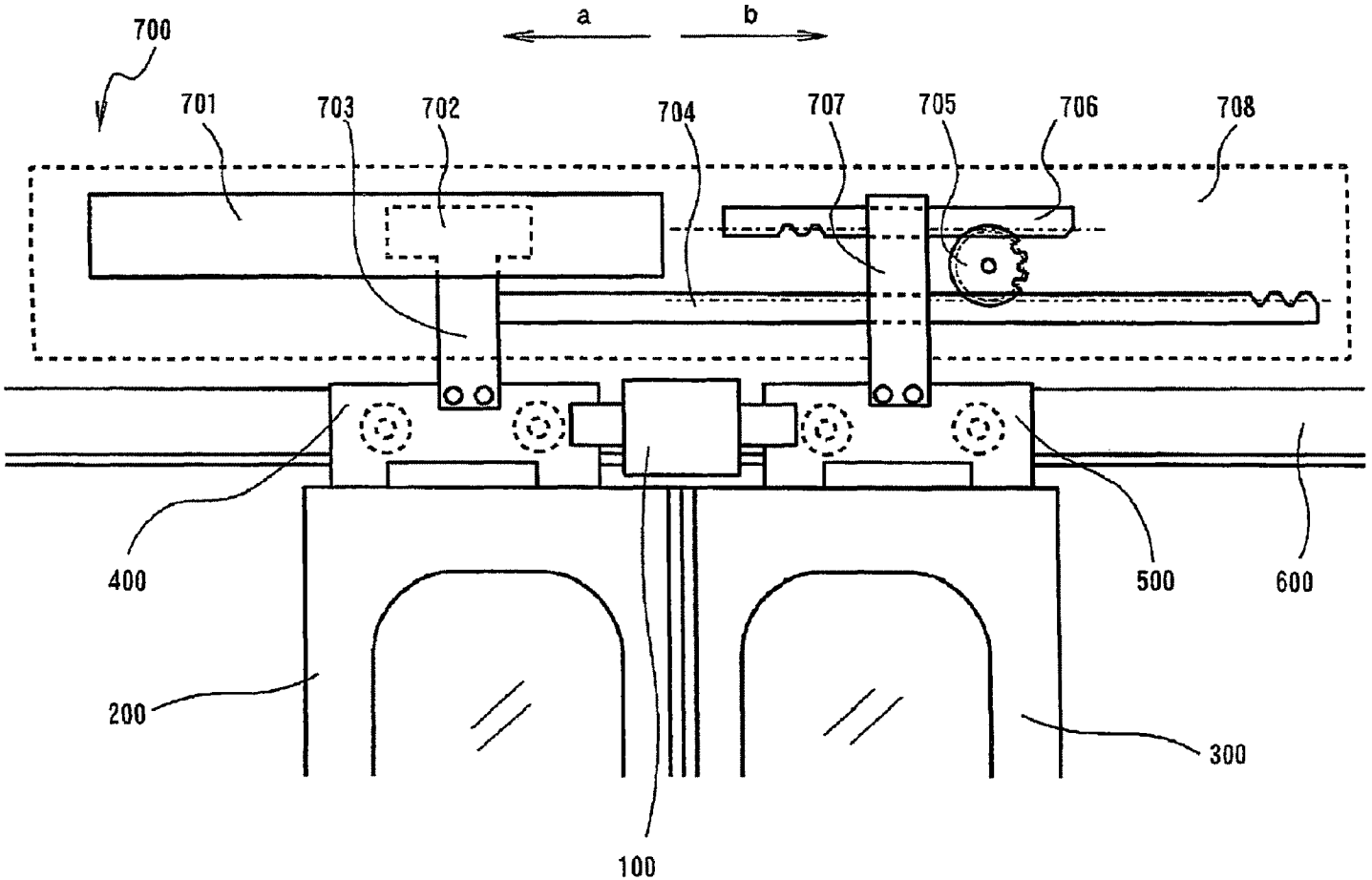
FIG. 2 is a structural diagram of an opening/closing drive device of the sliding door opening/closing device for a vehicle of an embodiment of the present invention.

The opening/closing drive device 700 opens and closes the rail moving bodies 400, 500 synchronously to the left and right. The opening/closing drive device 700 may be of various kinds. For example, an opening/closing drive device 700 of a linear motor type, such as shown in FIG. 2, can be used. The opening/closing drive device 700 is provided with a linear motor 701, a moving member 702 that moves horizontally with respect to the linear motor 701, a link body 703 that is linked to the moving member 702, a first sliding door drive rack 704 that is linked to the link body 703 and supported to be movable in the horizontal direction, a sliding door drive pinion 705 that is meshed with the first sliding door drive rack 704, a second sliding door drive rack 706 that is meshed with the sliding door drive pinion 705 and supported to be movable in the horizontal direction, a link body 707 that is linked to the second sliding door drive rack 706, and a body 708 that accommodates the aforementioned components. The first sliding door drive rack 704 and second sliding door drive rack 706 are mounted so that they can move parallel each other, while the teeth thereof face each other, at two substantially parallel planes inside the body 708. The link body 703 is fixed to the rail moving body 400, and the link body 707 is fixed to the rail moving body 500. The link body 707 is configured so as to avoid contact thereof with the first sliding door drive rack 704. The body 708 of the opening/closing drive device 700 is fixed to a vehicle body (not shown in the figure).

The link body 703 is fixed to the rail moving body 400. The moving member 702 of the linear motor 701 and the sliding door drive first rack 704 are fixed to the link body 703. The moving member 702 moves in the horizontal direction in response to a magnetic force supplied by a stator (not shown in the figure) of the linear motor 701.

The first sliding door drive rack 704 attached to the link body 703 is configured so as to move parallel to the sliding door rail 600 and is meshed with the sliding door drive pinion 705. The pinion sliding door drive 705 meshes with the second sliding door drive rack 706. The pinion sliding door drive 705 drives the second sliding door drive rack 706 in the direction opposite the advance direction of the first sliding door drive rack 704. The second sliding door drive rack 706 is configured to move substantially parallel to the sliding door rail 600 and has the link body 707 attached thereto. The link body 707 is fixed to the rail moving body 500.

Thus, the opening/closing drive force supplied from the moving member 702 of the linear motor 701 is transmitted to the sliding door 200 via the link body 703 and rail moving body 400 and also transmitted to the sliding door 300 via the link body 703, first sliding door drive rack 704, sliding door drive pinion 705, second sliding door drive rack 706, link body 707, and rail moving body 500.

The operation of opening and closing the sliding doors that is performed by the sliding door opening/closing device 1 for a vehicle of the present embodiment will be described below. Where the moving member 702 of the linear motor 701 moves the link body 703, which is fixed to the moving member 702, in the direction of arrow (a) (to the left), as shown in FIG. 2, in a state in which the sliding doors are closed as shown in FIG. 1, the sliding door 200 also moves in the direction of arrow (a).

Figure 3:
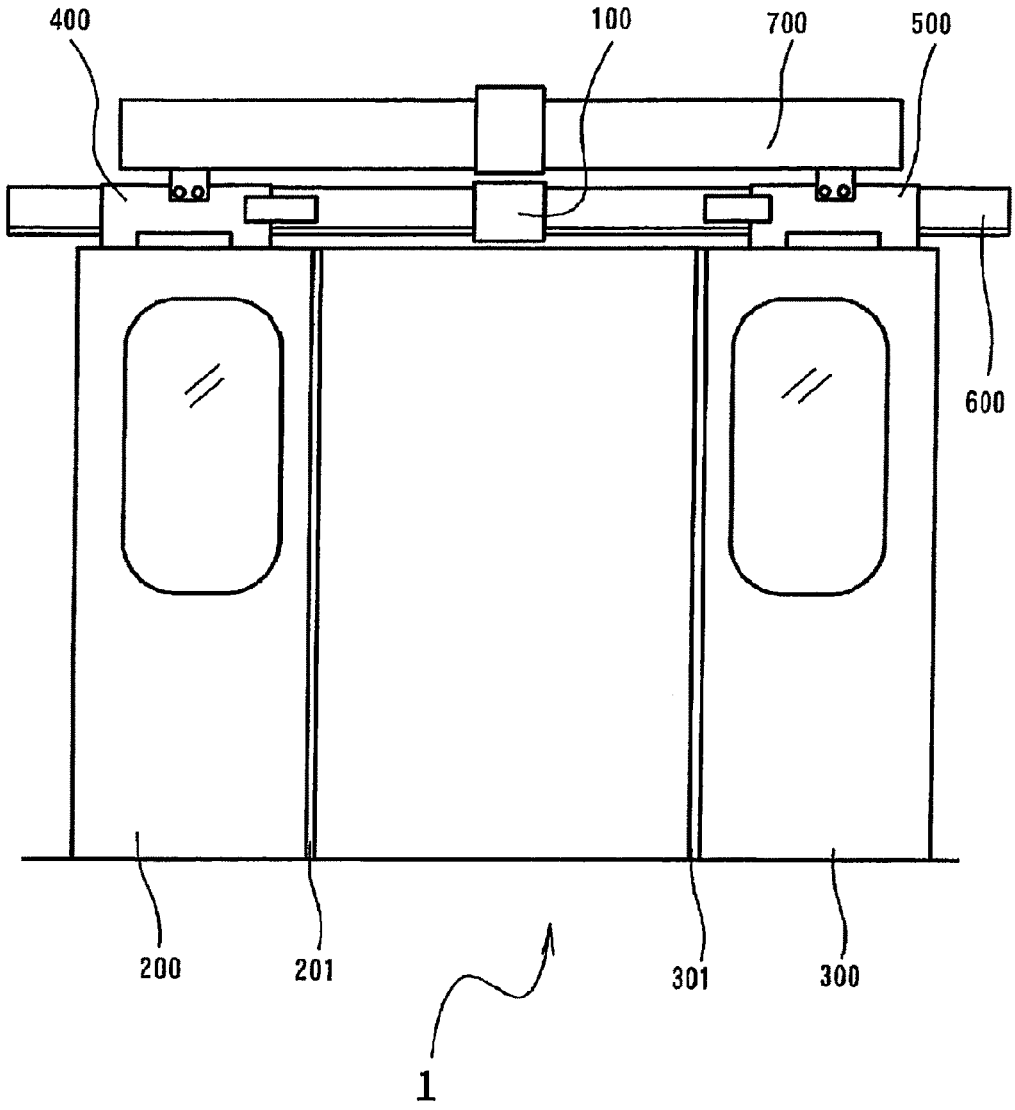
FIG. 3 is an explanatory drawing illustrating a state of the sliding door opening/closing device for a vehicle of an embodiment of the present invention in which the sliding doors are opened.

At the same time as the link body 703 moves in the direction of arrow (a) (to the left), the first sliding door drive rack 704 also moves in the direction of arrow (a) (to the left). The first sliding door drive rack 704 rotationally drives the sliding door drive pinion 705, and the pinion sliding door drive 705 drives the second sliding door drive rack 706 in the direction of arrow (b) (to the right). The second sliding door drive rack 706 drives the link body 707, which is fixed to the second sliding door drive rack 706, in the direction of arrow (b) (to the right), and the sliding door 300 is driven in the direction of arrow (b) (to the right). The operations of opening the sliding doors 200 and 300 are performed simultaneously. The sliding doors 200, 300 thus assume an open state such as shown in FIG. 3.

Figure 4:
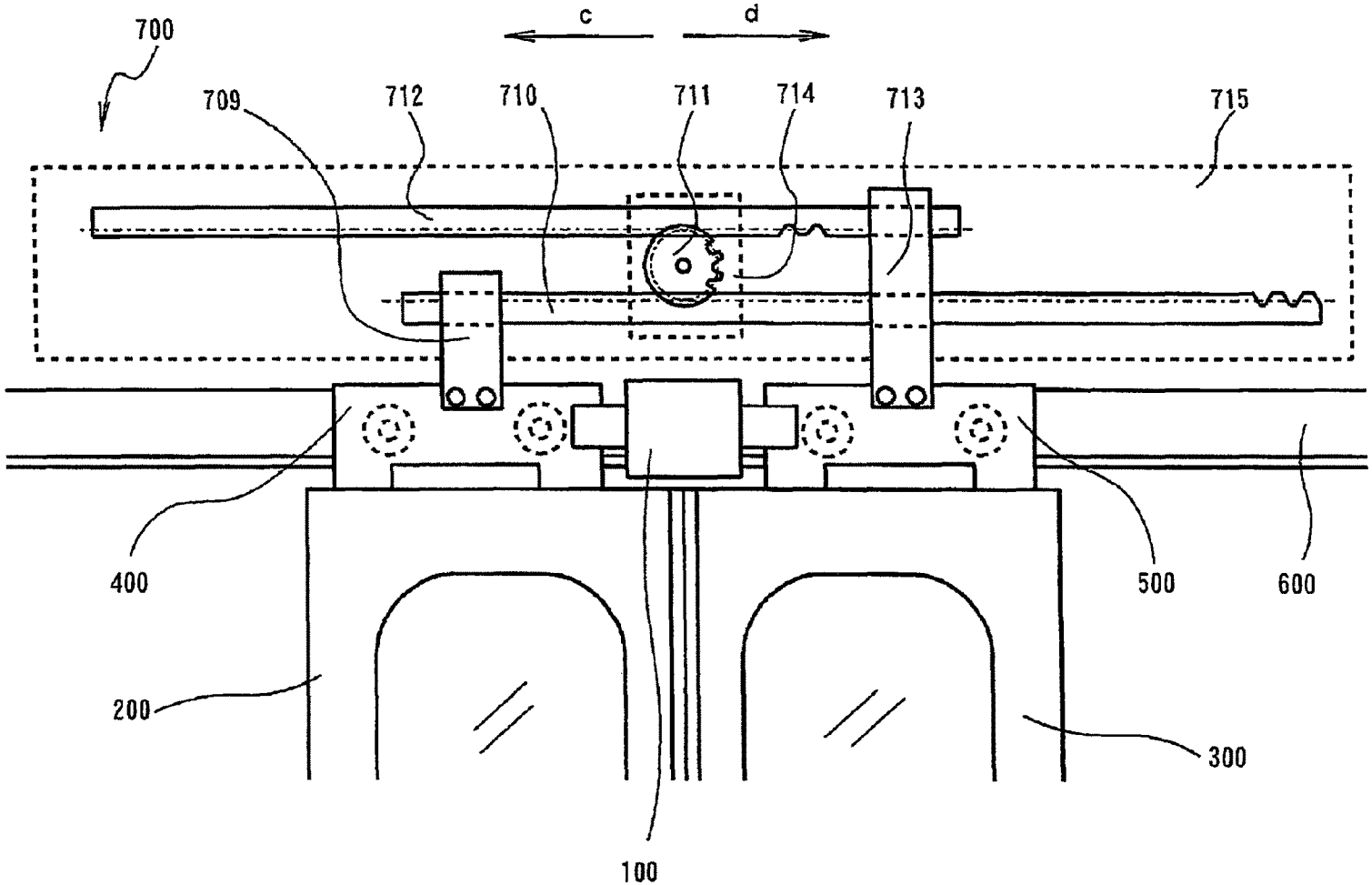
FIG. 4 is a structural diagram of another opening/closing drive device of the sliding door opening/closing device for a vehicle of an embodiment of the present invention.

An opening/closing drive device 700 of a rotary motor type such as shown in FIG. 4 may be used as another opening/closing drive device. This opening/closing drive device 700 is provided, for example, as shown in FIG. 4, with a link body 709, a first sliding door drive rack 710 that is linked to the link body 709 and supported to be movable in the horizontal direction, a sliding door drive pinion 711 that is meshed with the first sliding door drive rack 710, a second sliding door drive rack 712 that is meshed with the sliding door drive pinion 711 and supported to be movable in the horizontal direction, a link body 713 that is linked to the second sliding door drive rack 712, a sliding door drive motor 714 that rotationally drives the sliding door drive pinion 711, and a body 715 that accommodates the aforementioned components. The drive axis of the sliding door drive motor 714 extend in the direction perpendicular to the paper sheet in FIG. 4, and the body is shown in the figure only in mutual arrangement by a dot line. The first sliding door drive rack 710 and second sliding door drive rack 712 are mounted so that they can move parallel to each other, while the teeth thereof face each other, at two substantially parallel planes inside the body 715. The link body 709 is fixed to the rail moving body 400, and the link body 713 is fixed to the rail moving body 500. The link body 713 is configured so as to avoid contact thereof with the first sliding door drive rack 710. The body 715 of the opening/closing drive device 700 is fixed to a vehicle body (not shown in the figure).

The sliding door drive motor 714 rotationally drives the sliding door drive pinion 711. The sliding door drive pinion 711 meshes with the first sliding door drive rack 710 and second sliding door drive rack 712. When the sliding door drive pinion 711 rotates, the first sliding door drive rack 710 and second sliding door drive rack 712 are driven to move in opposite directions.

The operation of opening and closing the sliding doors with the sliding door opening/closing device for a vehicle of the present embodiment will be described below. In the state in which the sliding door is closed as shown in FIG. 1, when the sliding door drive motor 714 rotationally drives the sliding door drive pinion 711 as shown in FIG. 4, the first sliding door drive rack 710 and the link body 709, which is fixed to the first sliding door drive rack 710, move in the direction of arrow (c) (to the left), and the sliding door 200 also moves in the direction of arrow (c). Further, the second sliding door drive rack 712 and the link body 713, which is fixed to the second sliding door drive rack 712, move in the direction of arrow (d) (to the right), and the sliding door 300 also moves in the direction of arrow (d) (to the right). The sliding doors 200, 300 thus assume an open state such as shown in FIG. 3.

A device using a belt drive or a device using a feed screw drive may be also used as another opening/closing drive device 700. The entire structure of the sliding door opening/closing device 1 for a vehicle is described above.

Figure 5:
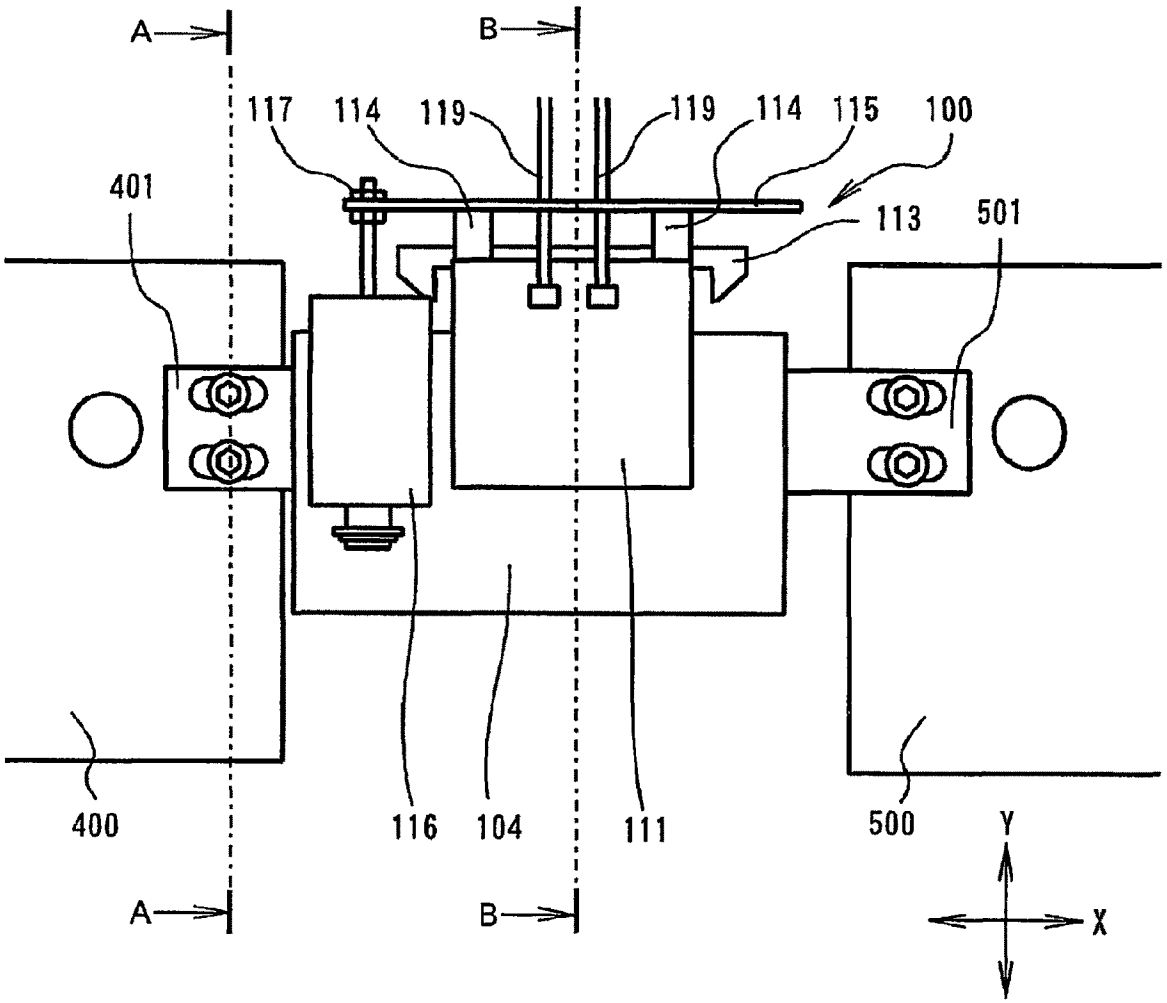
FIG. 5 is a front view of the lock device of the sliding door opening/closing device for a vehicle of an embodiment of the present invention.

The lock device 100 will be described below in greater detail with reference to the appended drawings. The configuration of the lock device 100 will be described with reference to FIGS. 5, 6, 7, 8, 9, 10, 11, and 12. The explanation below is conducted under an assumption that the arrow X direction is the left-right direction, and the arrow Y direction is the up-down direction, as shown in FIG. 5. Further, FIG. 7 shows a side view of the lock device in which a locking part 402 is omitted.

The lock device 100 is provided with a rear surface base 101, a lower base 102, an upper base 103, a front surface base 104, an iron yoke 105, an iron yoke 106, a nonmagnetic body 107, a columnar permanent magnet 108, a pinion 109, a rack 110, a lifting base 111, a slide rail 112, a latch 113, a support column 114, a locking plate 115, an actuator 116, a shaft fixing portion 117, an elastic body 118, an inner wire 119, an outer wire 120, a handle device 121, a hole 122, a hole 123, a gap 124, and a gap 125.

Figure 6:
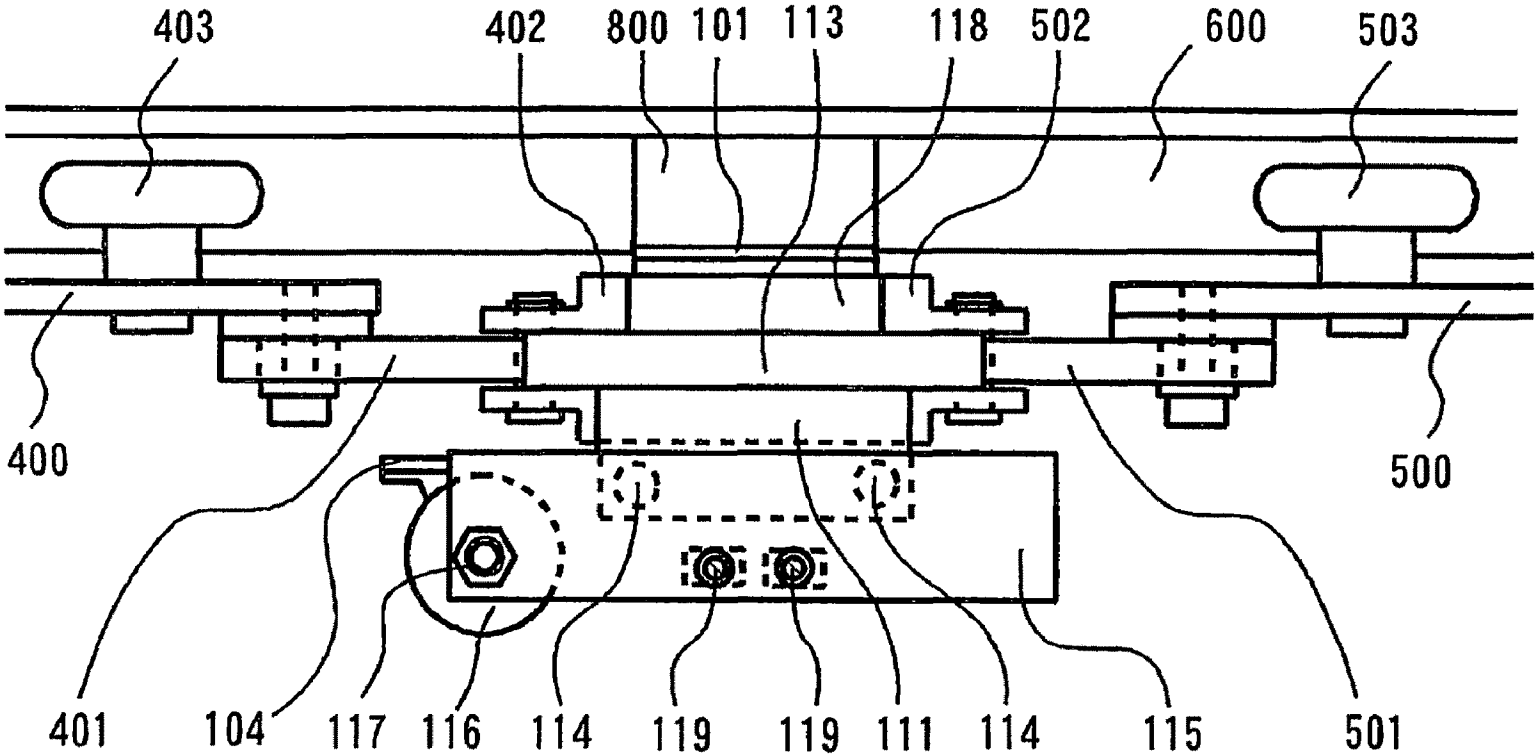
FIG. 6 is a plan view of the lock device of the sliding door opening/closing device for a vehicle of an embodiment of the present invention.
Figure 7:
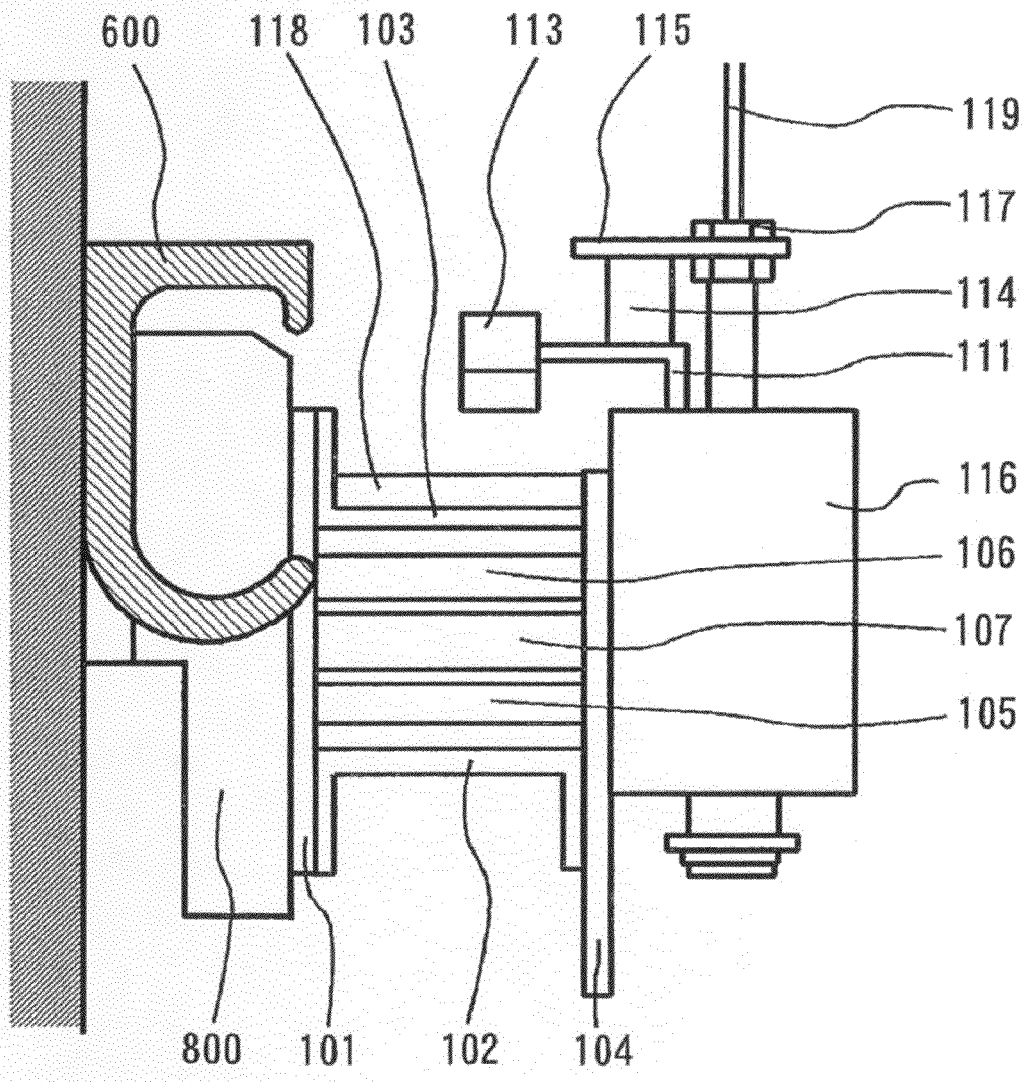
FIG. 7 is a sectional view along section A-A of the lock device of the sliding door opening/closing device for a vehicle of an embodiment of the present invention.
Figure 11:
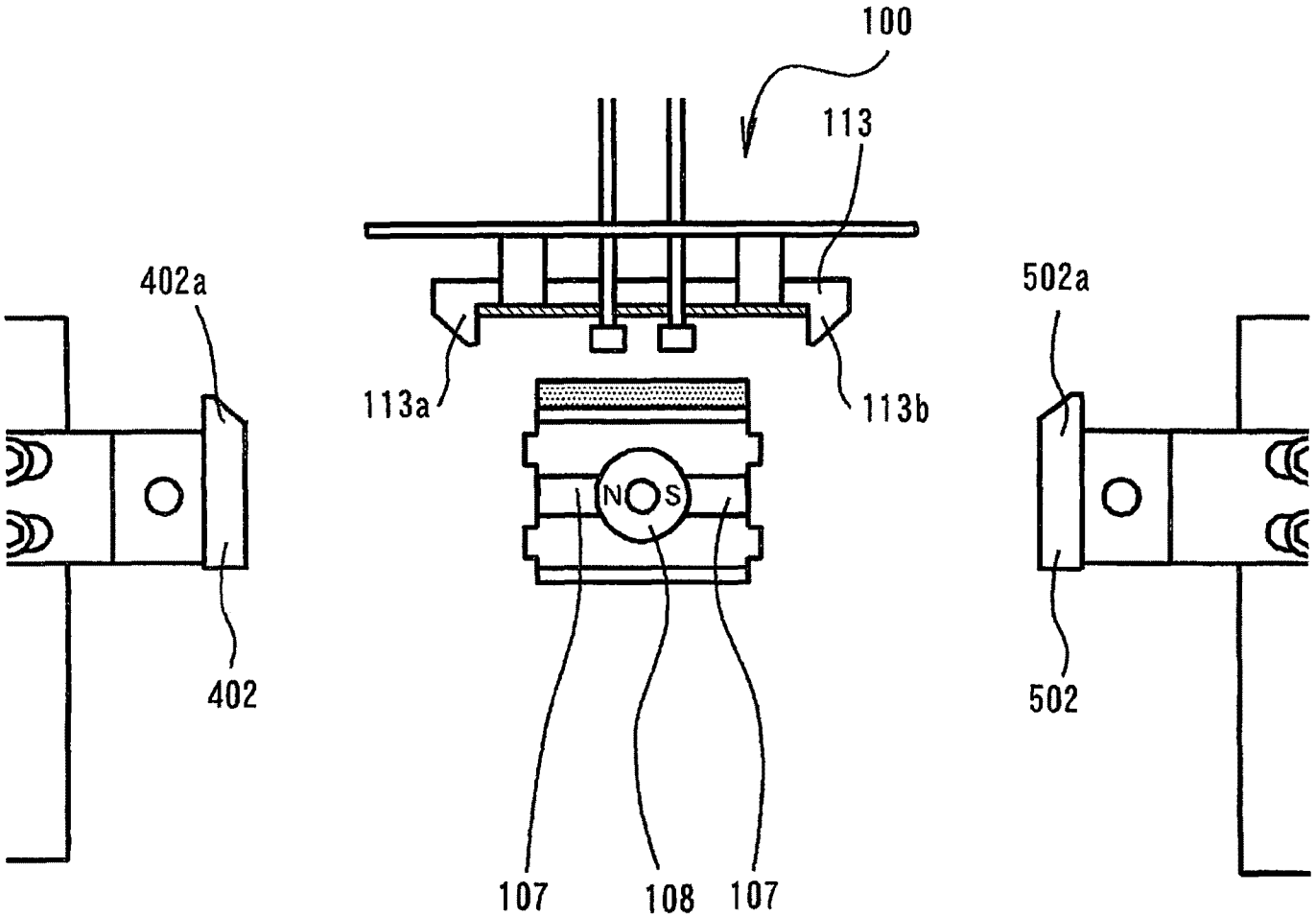
FIG. 11 shows an internal structure of the lock device in the unlocked state.

As shown in FIG. 6, a locking portion 402 is attached to the rail moving body 400, with an iron arm portion 401 being interposed therebetween. A door wheel 403 can move on a door wheel rail 600. Further, a locking portion 502 is attached to the rail moving body 500, with an iron arm portion 501 being interposed therebetween. A door wheel 503 can move on the door wheel rail 600. The locking portion 402, lock device 100, and locking portion 502 are disposed side by side along the sliding door rail 600. These locking portions 402, 502 are both formed by magnetic bodies. In particular, as shown in FIG. 11, these locking portions are formed to have protruding portions 402*a*, 502*a* that protrude upward. The lock device 100 has a locking function of maintaining the closed state of the sliding doors 200, 300 by fixing when the device comes by the side surfaces thereof into contact with the locking portions 402, 502 that come close thereto as the sliding doors 200, 300 are closed.

The configuration of each component will be described below.

Figure 8:
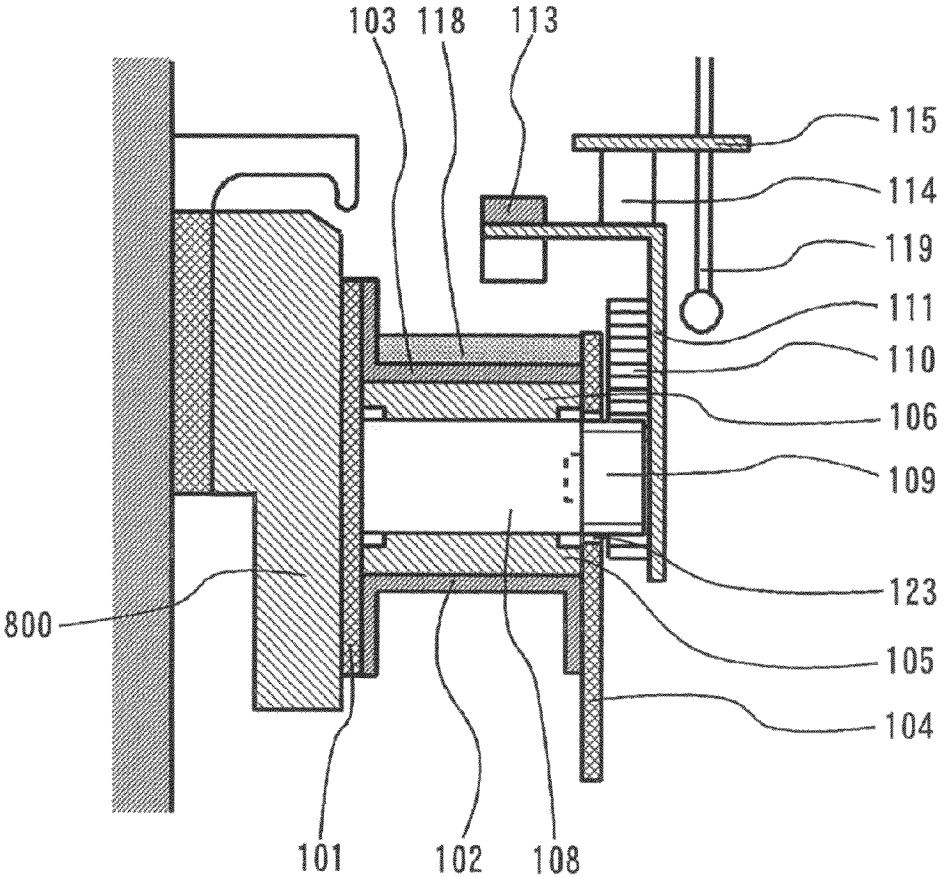
FIG. 8 is a sectional view along section B-B of the lock device of the sliding door opening/closing device for a vehicle of an embodiment of the present invention.
Figure 12:
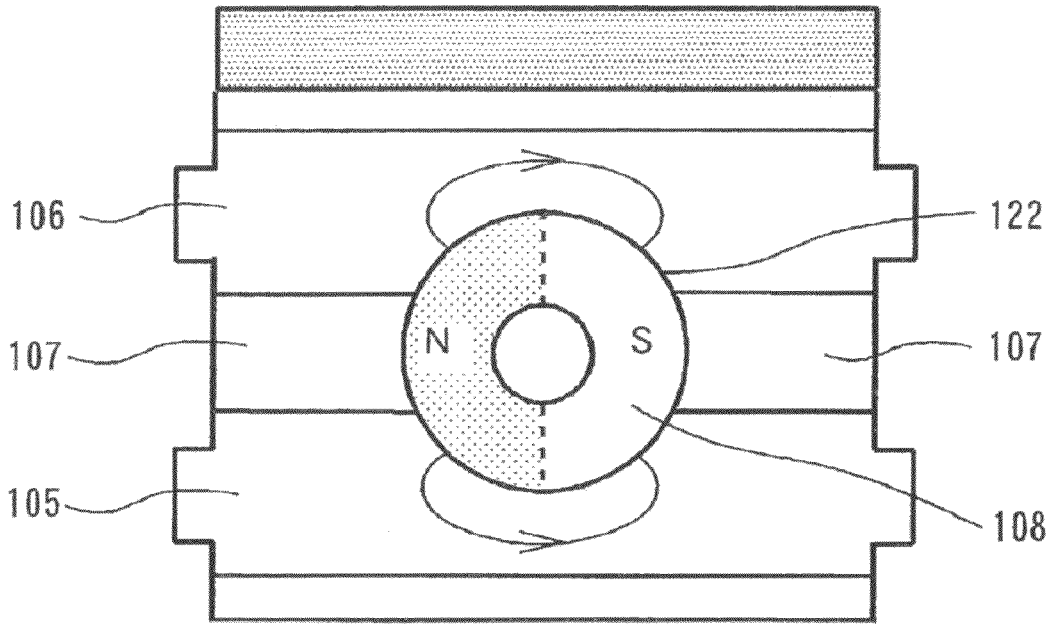
FIG. 12 is an explanatory drawing of a magnetic circuit for unlocking that is formed in the unlocked state of the lock device.

The rear surface base 101 is made from iron and is a plate body as shown in FIGS. 7 and 8. The rear surface base 101 is fixed to a pedestal portion 800 provided at the vehicle body, thereby fixing the lock device 100. A lower base 102 made of iron and having a Π-like shape in the side view and an upper base 103 made from iron and having an L-like shape in the side view are fixed to the rear surface base 101. As shown in FIG. 12, the iron yoke 105 formed from a magnetic body is also fixed to the lower base 102. The iron yoke 106 formed from a magnetic body is fixed to the upper base 103. Two plate-shaped nonmagnetic bodies 107 are disposed between the iron yoke 105 and iron yoke 106. These iron yoke 105, non-magnetic bodies 107, and iron yoke 106 form a magnetic circuit mechanism.

A hole 122 passing through the iron yoke 105, iron yoke 106, and nonmagnetic body 107 is formed in the center of the magnetic circuit mechanism, and the columnar permanent magnet 108 is rotatably supported in the hole 122. The front surface base 104 is fixed to the lower base 102, iron yoke 105, nonmagnetic body 107, iron yoke 106, and upper base 103 so as to cover the iron yoke 105, iron yoke 106, and nonmagnetic body 107. These rear surface base 101, lower base 102, upper base 103, front surface base 104, iron yoke 105, iron yoke 106, nonmagnetic body 107, and columnar permanent magnet 108 constitute the magnetic lock device in accordance with the present invention.

Figure 10:
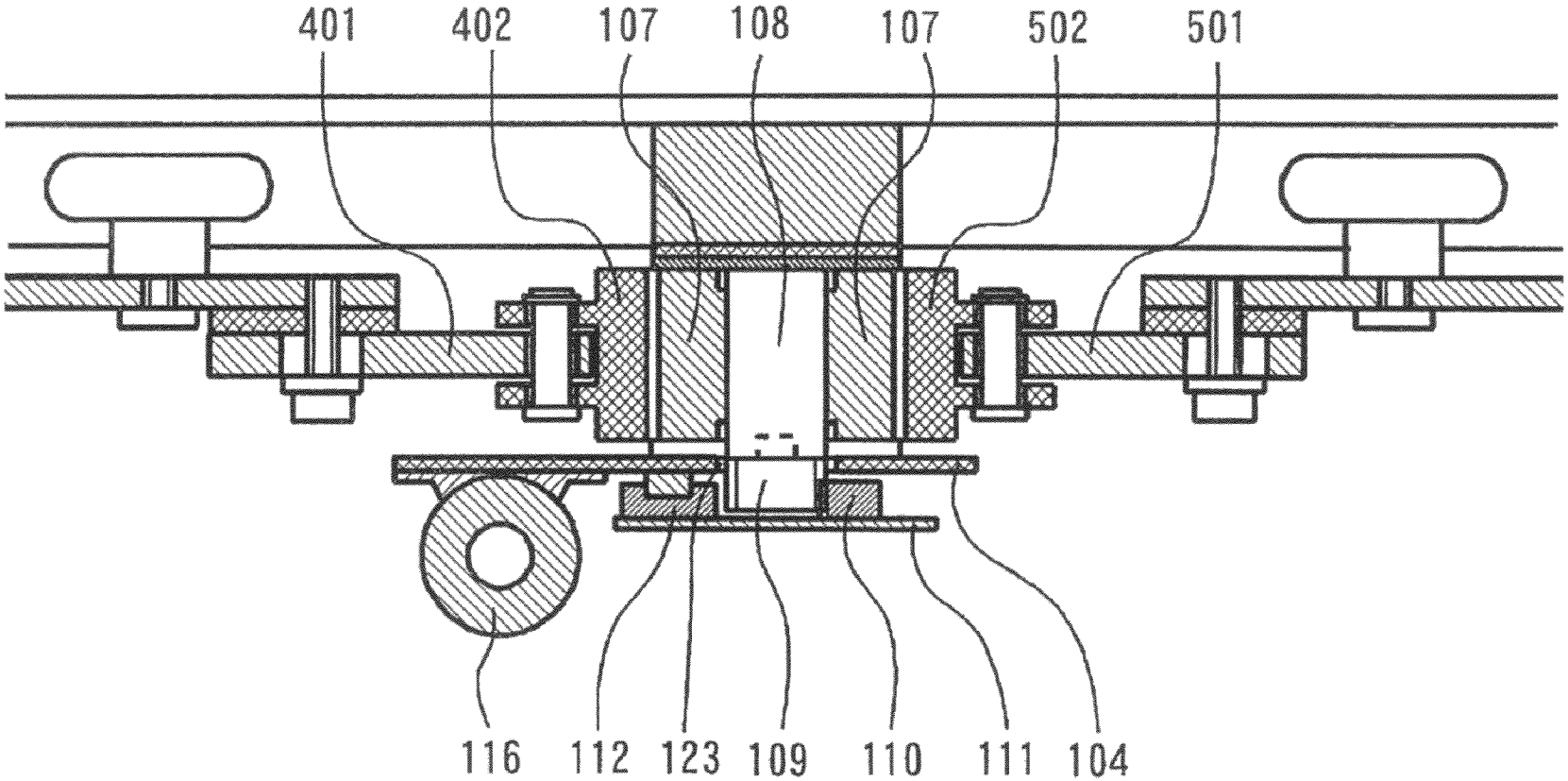
FIG. 10 is a sectional view along section C-C of the lock device of the sliding door opening/closing device for a vehicle of an embodiment of the present invention.

A hole 123 is also formed, as shown in FIGS. 8 and 10, in the front surface base 104, and the pinion 109 can be coupled and fixed to the columnar permanent magnet 108 through the hole 123. The columnar permanent magnet 108 and pinion 109 are constituted so as to be disposed coaxially and rotate together without eccentricity.

Figure 9:
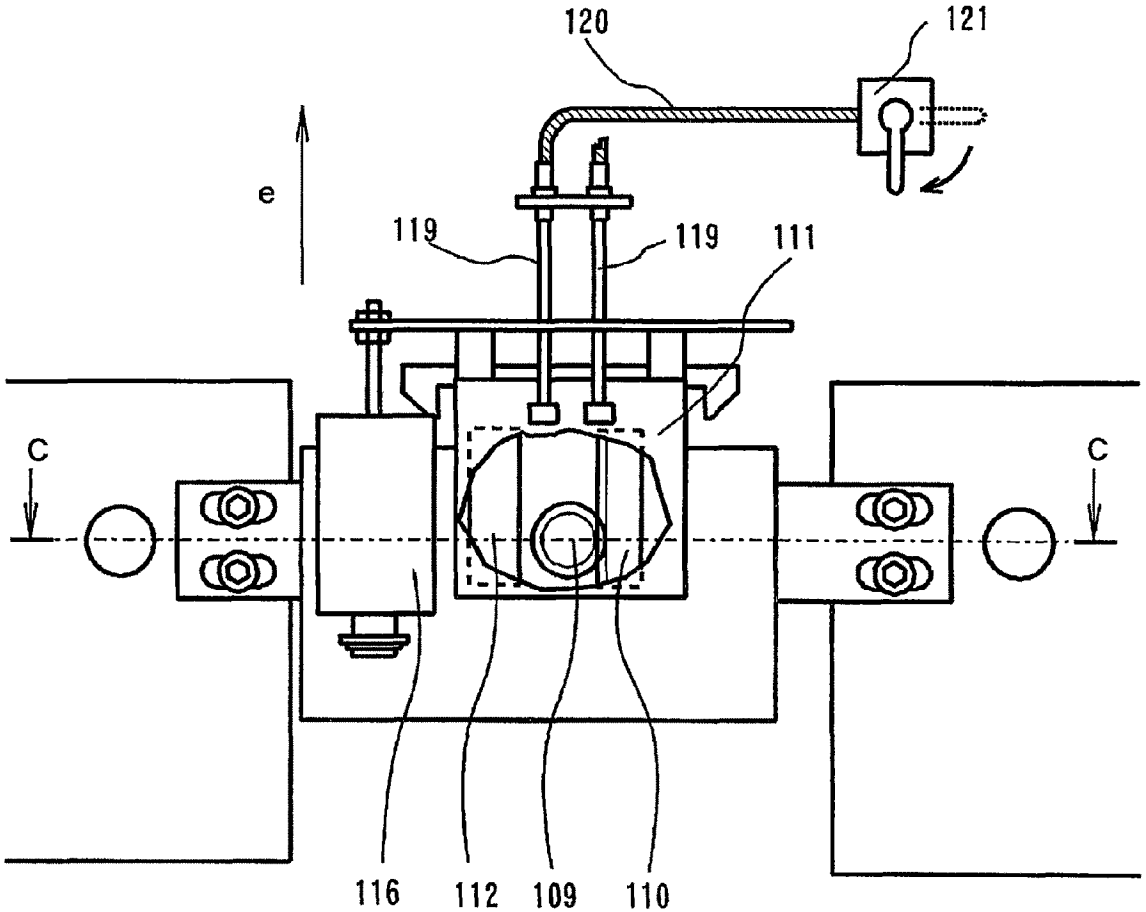
FIG. 9 is partially cut-out sectional view of the lock device of the sliding door opening/closing device for a vehicle of an embodiment of the present invention.

As shown in FIGS. 9 and 10, a rail portion of the slide rail 112 is fixed at the front surface side of the front surface base 104, and the lifting base 111 is further fixed to the moving portion of the slide rail 112. Further, the pinion 109 is disposed at the front surface side of the front surface base 104, and the rack 110 is disposed and fixed at the rear surface side of the lifting base 111. The pinion 109 and rack 110 are disposed to mesh with each other.

In other words, due to the presence of the slide rail 112, the lifting base 111 can easily move in the vertical direction with respect to the front surface base 104. Further, where the lifting base 111 is driven so as to be lifted with respect to the front surface base 104, the pinion 109, which meshes with the rack 110, rotates and the columnar permanent magnet 108 also rotates. Conversely, where the columnar permanent magnet 108 rotates, the rack 110, which meshes with the pinion 109, moves in the vertical direction and the lifting base 111 is lifted or lowered. These pinion 109, rack 110, lifting base 111, and slide rail 112 constitute a conversion unit in accordance with the present invention that converts the rotational movement into the vertical movement and vice versa.

As shown in FIG. 8, the lifting base 111 is made from iron, has a Γ-like shape in the side view, and can move up and down in the vertical direction with respect to the front surface base. A latch 113 made of iron and having a Π-like shape in the front view is attached to the distal end of the lifting base 111, as shown in FIG. 11. The latch 113 is moved down when the door is closed, positioned on a path of the protruding portion 402*a* of the locking part 402 or the protruding portion 502*a* of the locking part 502 that are attached at both sides of the lock device 100, and restrained to prevent it from moving. The elastic body 118 is disposed above the upper base 103, and where the latch 113 abuts against the elastic body 118, the downward movement of the latch 113 is restrained. In this state, only the left and right protruding portions 113*a*, 113*b* of the latch 113 (see FIG. 11) serve as restraining portions. The elastic body 118 also absorbs impacts during collision.

As shown in FIGS. 6 and 7, the locking plate 115 is fixed above the lifting base 111, with two support columns 114 being interposed therebetween. Where a vertical force is applied to the locking plate 115, the lifting base 111 is also moved in the vertical direction.

The actuator 116 is fixed to the front surface of the front surface base 104, and a lifting shaft is fixed by the shaft fixing portion 117 to the locking plate 115. The actuator 116 causes the locking plate 115 to move in the vertical direction and moves the lifting base 111 in the vertical direction.

This conversion unit (pinion 109, rack 110, lifting base 111, and slide rail 112), latch 113, support columns 114, and locking plate 115 constitute the latch lifting lock device in accordance with the present invention.

As shown in FIG. 9, the inner wire 119 is inserted into the outer wire 120 that has a strong tubular structure and can move inside the outer wire 120. These inner wire 119 and outer wire 120 constitute a wire device. Where the handle device 121 located on the opposite side is operated, the locking plate 115 is pulled and lifted in the direction of arrow (e) via the inner wire 119, and the entire latch lifting lock device is lifted. In this case, the pulling amount of the inner wire is adjusted so that the columnar permanent magnet 108 is rotated by the pinion 109 through about 90°. The operation using the handle device 121 and wire device is conducted only for unlocking, and the opening/closing operation of the sliding doors 200, 300 is performed manually.

Locking and unlocking with the lock device 100 will be explained below with reference to FIGS. 1, 3, 11, 12, 13, 14, 15, and 16. In FIGS. 11 to 16, some parts are omitted to clarify the internal structure and magnetic circuit formation in the lock device.

Initially, an unlocked state is assumed in which the sliding doors 200, 300 are opened, as shown in FIG. 3. In this case, as shown in FIG. 11, the latch 113 is in the lifted state. In the columnar permanent magnet 108, the N pole and S pole are assumed to be in a horizontal direction (left-right direction), as shown in FIGS. 11 and 12. The locking portions 402, 502 are positioned at a sufficient distance from the lock device 100 as shown in FIGS. 11 and 12. In this case, as shown in FIG. 12, a magnetic circuit is formed by the columnar permanent magnet 108 and upper iron yoke 106 and a magnetic circuit is also formed by the columnar permanent magnet 108 and lower iron yoke 105. These magnetic circuits are internally formed magnetic circuits for unlocking. The magnetic force of the magnetic circuits for unlocking stops the rotation of the columnar permanent magnet 108, and the latch 113 is fixed in a lifted state. An initial rotation force, obtained by converting the lowering force created by the weight of the latch lifting lock device, is applied to the columnar permanent magnet 108 of the lock device 100 in one direction, but because the magnetic force created by the magnetic circuits for unlocking is stronger than the initial rotation force, the columnar permanent magnet 108 does not rotate and the latch 113 is maintained in the lifted position. Because no magnetic force is formed between the lower iron yoke 105 and upper iron yoke 106, the attachment forces at both side surfaces of the iron yokes 105, 106 are zero.

Figure 13:
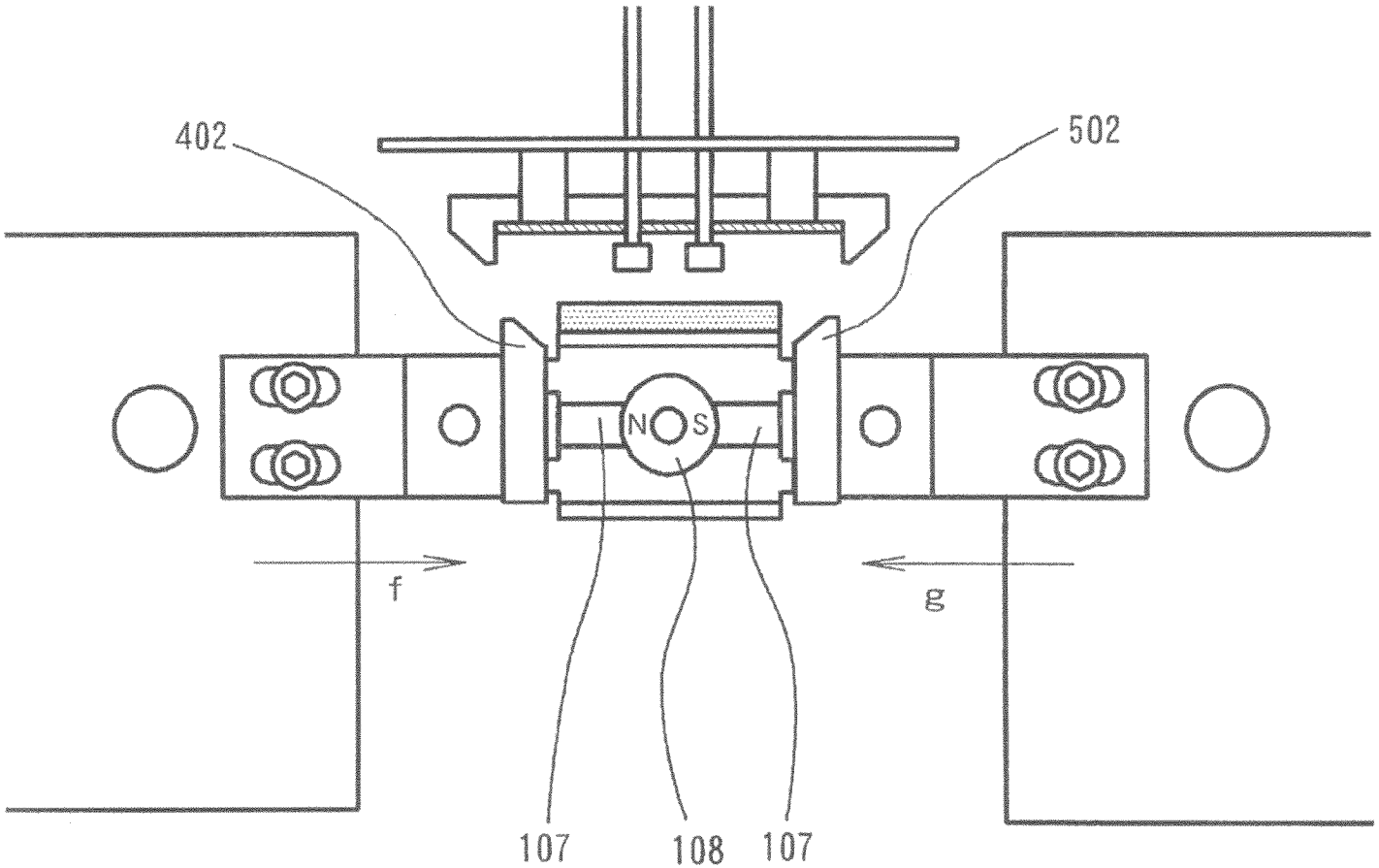
FIG. 13 shows an internal structure of the lock device during locking when the locking portions are in contact.

Locking with the lock device 100 (transition from the unlocked state to the locked state) is conducted in the following manner. The opening/closing drive device 700 conducts the door closing drive and closes the sliding doors 200, 300 as shown in FIG. 1. In this case, as shown in FIG. 13, the locking portion 402 of the rail moving body 400 moves in the direction of arrow (f), and the locking portion 502 of the rail moving body 500 simultaneously moves in the direction of arrow (g). The locking portions 402, 502 eventually abut against the lock device 100.

Figure 14:
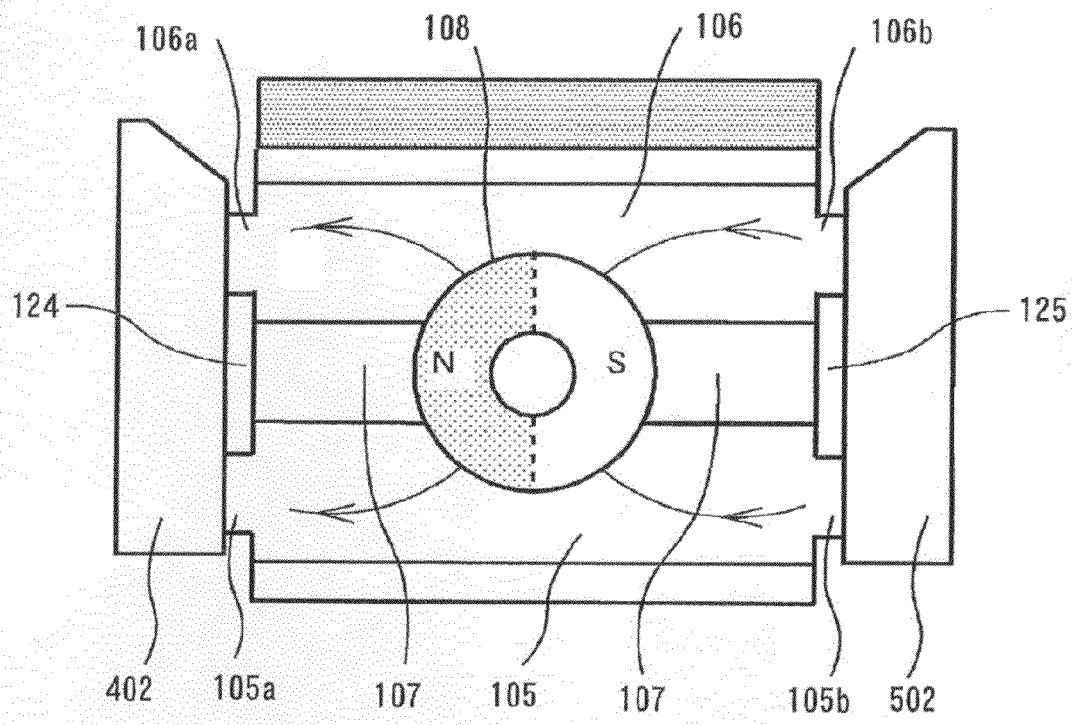
FIG. 14 is an explanatory drawing of a magnetic circuit formed when the lock device is locked and the locking portions are in contact.

In the lock device 100, the protruding portions 105*a*, 105*b* are formed at the side surface of the iron yoke 105, as shown in detail in FIG. 14. Further, the protruding portions 106*a*, 106*b* are formed at the side surface of the iron yoke 106. Where the locking portion 402 abuts against the protruding portions 105*a*, 106*a*, a gap 124 is formed, and where the locking portion 502 abuts against the protruding portions 105*b*, 106*b*, a gap 125 is formed. Because of the gaps 124, 125, the locking portions 402, 502 are caused to abut only in the positions that are located above and below the nonmagnetic body 107 and the magnetic circuit is formed reliably.

In this case, as shown in FIG. 14, a magnetic circuit is formed in which magnetic force lines return from the N pole of the columnar permanent magnet 108 to the N pole through the locking portion 402, and a magnetic circuit is formed in which magnetic force lines return from the S pole of the columnar permanent magnet 108 to the S pole through the locking portion 502. However, in this case a repulsive force acts, and therefore the columnar permanent magnet 108 is to be rotated in order to prevent the repulsive force from acting.

Concerning the rotation direction, an initial rotation force, which is obtained by converting the lowering force created by the weight of the latch lifting lock device, is applied to the columnar permanent magnet 108 of the magnetic lock device in one direction (in the direction of arrow (h), that is, the clockwise direction). Therefore, the columnar permanent magnet 108 rotates and the latch 113 is lowered mechanically in the direction of arrow (i). The latch 113 then abuts against the elastic body 118, and the columnar permanent magnet 108 is stopped in a position such that the N pole and S pole are oriented in the vertical direction as shown in FIGS. 15 and 16.

Figure 16:
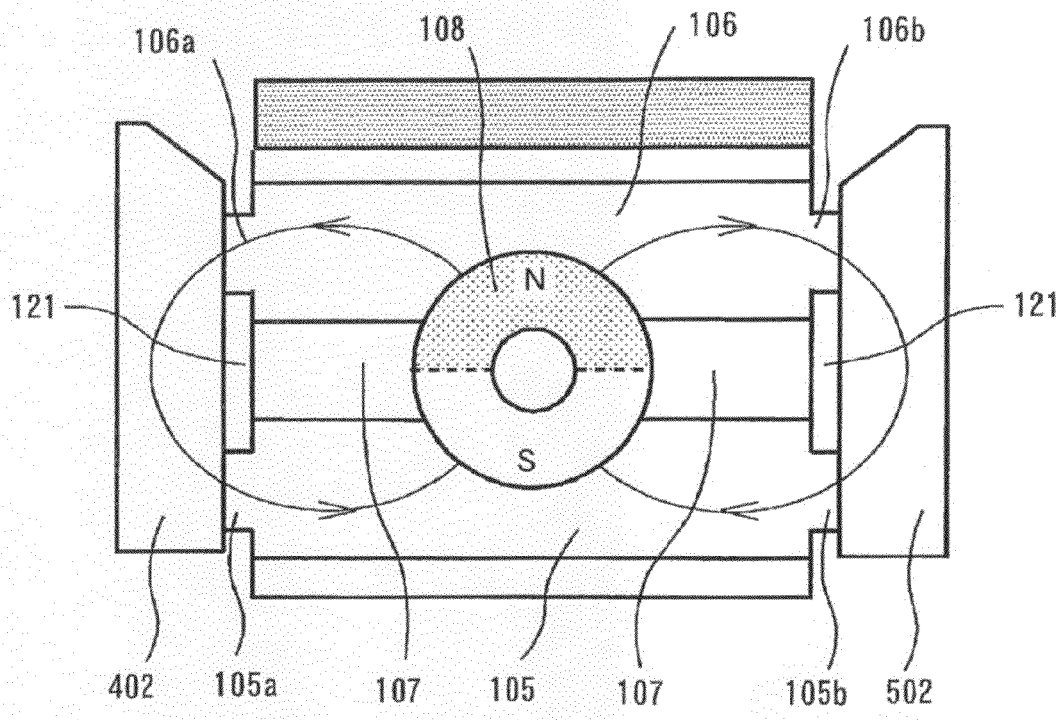
FIG. 16 is an explanatory drawing of a magnetic circuit for locking that is formed in the locked state of the lock device.

In this case, as shown in FIG. 16, a magnetic circuit is formed in which the magnetic force lines return to the S pole of the columnar permanent magnet 108 via the N pole of the columnar permanent magnet 108, upper iron yoke 106, locking portion 402, and lower iron yoke 105, a magnetic circuit is formed in which the magnetic force lines return to the S pole of the columnar permanent magnet 108 via the N pole of the columnar permanent magnet 108, upper iron yoke 106, locking portion 502, and lower iron yoke 105, and the system is stabilized. As a result, the columnar permanent magnet 108 does not move and maintains the position. These magnetic circuits are magnetic circuits for locking. Under the effect of magnetic forces of these magnetic circuits for locking, the locking portions 402, 502 are attached and fixed to the lock device 100.

Figure 15:
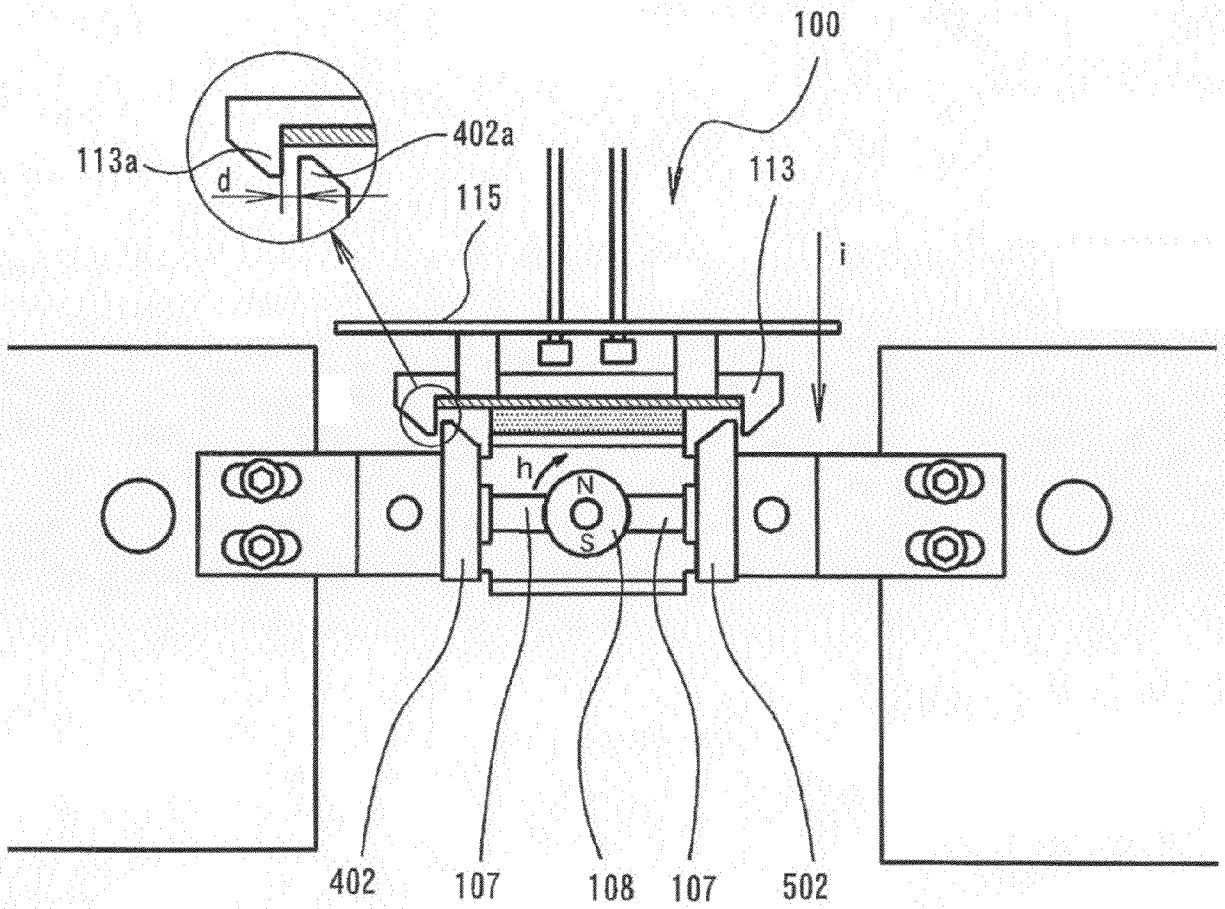
FIG. 15 shows an internal structure of the lock device in the locked state.

The rotational movement of the pinion 109 that rotates together with the columnar permanent magnet 108 is converted into a descending movement of the rack 110, the latch 113 moves in the direction of arrow (i) in FIG. 15 and descends, and the latch 113 abuts against the elastic body 118 and stops. This stop position is adjusted so that the columnar permanent magnet 108 rotates through 90°. In this case, as shown in a circle in FIG. 15, a very small gap (d) is formed between the protruding portions 402*a*, 502*a* of the locking portions 402, 502 and the protruding portions 113*a*, 113*b* of the latch. Such an alignment is easy because the protruding portions 402*a*, 502*a* of the locking portions 402, 502 that are strongly fixed in the same position at all times by the magnetic circuits for locking are taken as a reference.

The attachment caused by the formation of the above-described magnetic circuits for locking and the descent of the latch 113 are attained simultaneously with the completion of rotation of the columnar permanent magnet 108.

Because the protruding portions 113*a*, 113*b* of the latch 113 are thus positioned on the movement paths of the locking portions 402, 502, the protruding portions are not separated from the lock device 100. With such a structure, even if the magnetic circuit for locking is opened in the locking process and unlocking is conducted, or when the attachment is incomplete, the sliding doors 200, 300 move through a distance equal to a very small gap (d) and the doors are not opened to more than the gap (d). Because this movement through the gap (d) is also absorbed by the deformation of the door end rubber 201, 301, the gap is formed between the sliding doors 200, 300. In accordance with the present invention, because of the gap (d) of the latch 113, the latch 113 has no mechanical contact, except that the latch 113 abuts against the elastic body 118. Therefore, there is practically no mechanical resistance and the lifting operation can be smoothly performed by a small force.

Thus, during locking, magnetic locking is performed in the magnetic lock device by which the locking portions 402, 502 are strongly attracted and fixed by magnetism. As a result, the sliding doors 200, 300 are strongly fixed. In this case, the sliding doors 200, 300 are closed by simple adjustment of regulating the attachment position of the arms 401, 501 to the locking portions 402, 502, thereby strongly closing the sliding doors 200, 300 in a predetermined door closing position.

Further, latch locking by the latch 103 is conducted simultaneously with the magnetic locking. Because magnetic locking ensures strong fixing, in the latch locking, the gap (d) is opened, mechanical interference is limited to positioning the protruding portions 103*a*, 103*b*, which are parts of the latch 103, at the path, and the latch 103 that is not in mechanical contact is smoothly lifted or lowered. By using latch locking in addition to magnetic locking it is possible to prevent the sliding doors 200, 300 from being unintentionally opened.

The usual unlocking with the lock device (transition from the locked state to the unlocked state) is performed in the following manner. It is assumed that in the unlocked state, the locking portions 402, 502 abut against the side surfaces of the lock device 100, as shown in FIG. 15. Further, the latch 113 is in a lowered state. For example, where an instruction to open the sliding doors 200, 300 is issued, the actuator 116 is actuated and moved through the distance X (mm) in the direction of arrow (j) and lifts the locking portion 115, as shown in FIG. 17.

Figure 17:
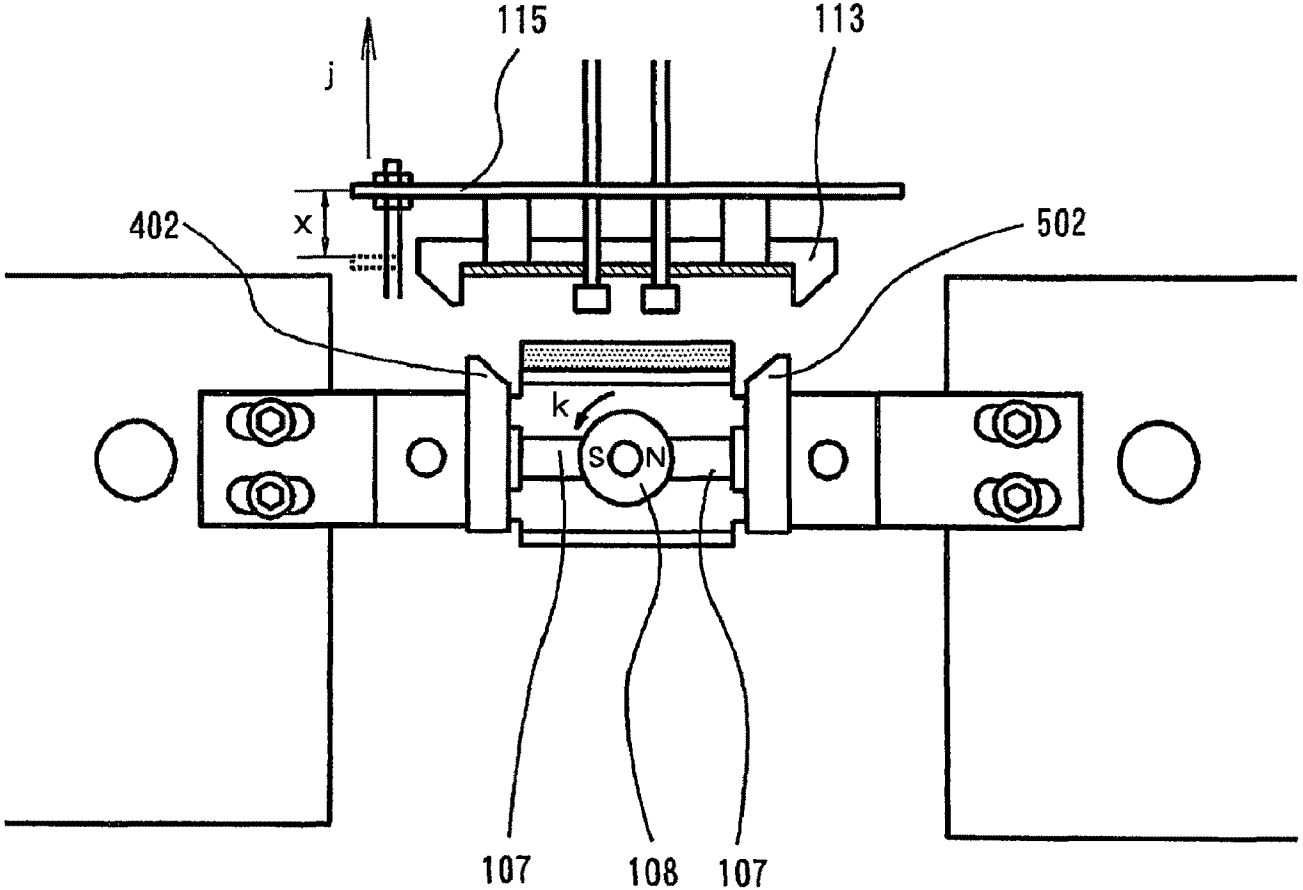
FIG. 17 is an explanatory drawing illustrating the operation of unlocking the lock device that is performed by the actuator.

Then, the operation of lifting the rack 110 in the direction of arrow (j) shown in FIG. 17 that is conducted as the locking portion 115 is lifted is converted into the operation of rotating the columnar permanent magnet 108 and the pinion 109 that rotates in the direction of arrow (k) (counterclockwise). The columnar permanent magnet 108 rotates through 90°. In this case, because the magnetic circuit is eliminated between the lower iron yoke 105 and upper iron yoke 106, the attachment forces at both side surfaces of the iron yokes 105, 106 become zero and the attachment state of the magnetic circuit is canceled.

Figure 18:
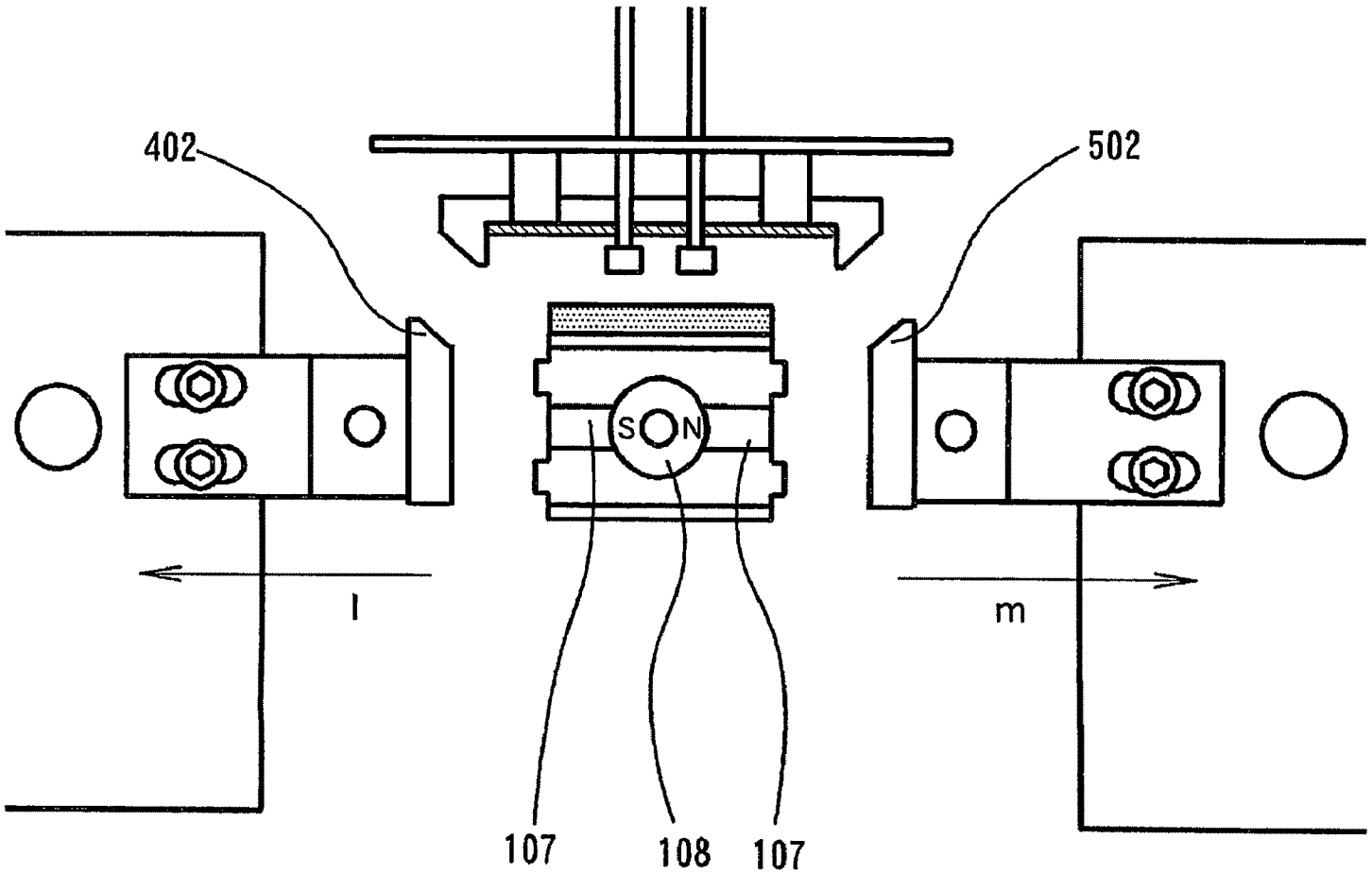
FIG. 18 is an explanatory drawing illustrating the operation of opening the sliding door in the lock device.

The opening/closing drive device 700 then opens the doors, and the sliding doors 200, 300 are opened as shown in FIG. 3. In this case, as shown in FIG. 18, the locking portion 402 of the rail moving body 400 moves in the direction of arrow (l), and the locking portion 502 of the rail moving body 500 simultaneously moves in the direction of arrow (m).

Further, as shown in FIG. 12, a magnetic circuit is formed by the columnar permanent magnet 108 and upper iron yoke 106, and a magnetic circuit is formed by the columnar permanent magnet 108 and lower iron yoke 105. Because of the magnetic forces of the magnetic circuits for unlocking, the rotation of the columnar permanent magnet 108 is stopped and the latch 113 is fixed in a lifted state. Therefore, the actuator 116 can be actuated only within a very short time from the moment the door is opened to immediately after the locking portions 402, 502 are separated.

Thus, simultaneously with lifting the latch 113, the magnetic circuit for locking is opened, strong attraction of the locking portions 402, 502 by the lock device 100 is released, and then the locking portions 402, 502 can be easily separated. In this case, too, practically no mechanical resistance is applied to the latch 113 due to the gap (d) formed by the protruding portions 113*a*, 113*b* of the latch 113 and the protruding portions 402*a*, 502*a* of the locking portions 402, 502. As a result, the lifting operation can be performed smoothly by a small force.

Thus, during unlocking, as the latch 113 is lifted, the locking portions 402, 502 are released from being magnetically attracted and fixed by the lock device 100 and, therefore, the opening operation can be performed at a high speed by a small force.

Figure 19:
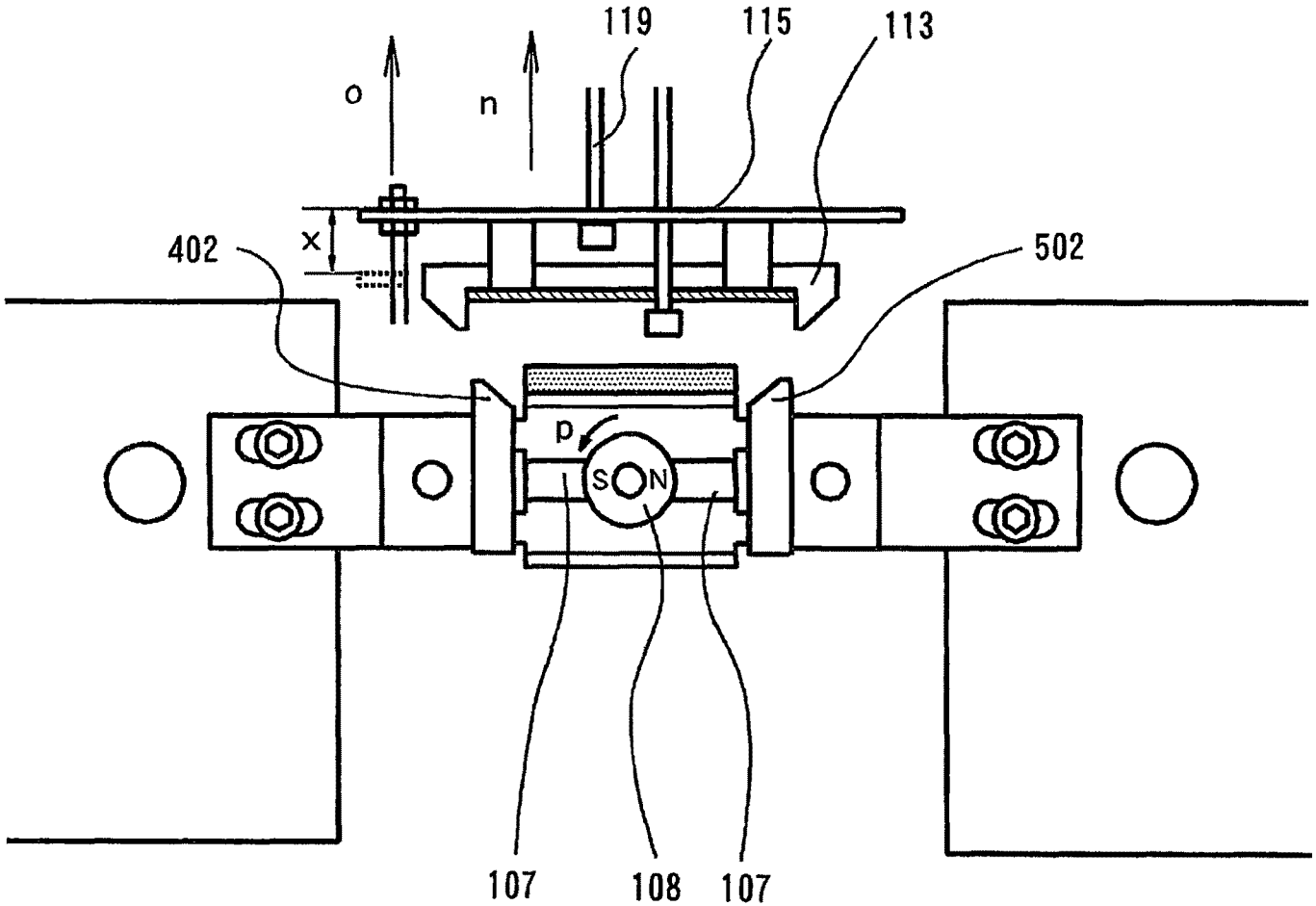
FIG. 19 is an explanatory drawing illustrating the operation of unlocking the lock device by the wire device.

Emergency unlocking (transition from the locked state to the unlocked state) with the lock device 100 is performed in the following manner. In emergency unlocking, unlocking is conducted with a handle device (emergency lock) 121 shown in FIG. 9. In the unlocked state, the locking portions 402, 502 are assumed to abut against the side surfaces of the lock device 100, as shown in FIG. 15. Further, in this state, the latch 113 is lowered. For example, where a handle operation is performed in the handle device 121, the inner wire 119 is driven in the direction of arrow (n), as shown in FIG. 19, and the locking plate 115 is lifted through a distance X (mm). As a result, the latch 113 is also lifted and the unlocked state is assumed. The inner wire 119 is fixed by the stopper of the handle device 121 in this pulled state.

The operation of lifting the rack 110 in the direction of arrow (o) shown in FIG. 19 that is performed as the latch 113 is lifted is converted into the operation of rotating the pinion 109 that rotates the columnar permanent magnet 108 in the direction of arrow (p) (counterclockwise). The columnar permanent magnet 108 rotates through 90° in the direction of arrow (p) (counterclockwise).

In this case, a magnetic circuit is formed by columnar permanent magnet 108 and the upper iron yoke 106 and a magnetic circuit is formed by columnar permanent magnet 108 and the lower iron yoke 105 as the magnetic circuits, as shown in FIG. 12. These magnetic circuits constitute magnetic circuits for unlocking. Magnetic forces of the magnetic circuits for unlocking stop the rotation of columnar permanent magnet 108, and the latch 113 is fixed in the lifted state. Further, the inner wire 119 is prevented from moving by the stopper, as described hereinabove, the locking plate 115 is fixed and prevented from lowering, and the columnar permanent magnet 108 does not rotate.

Figure 20:
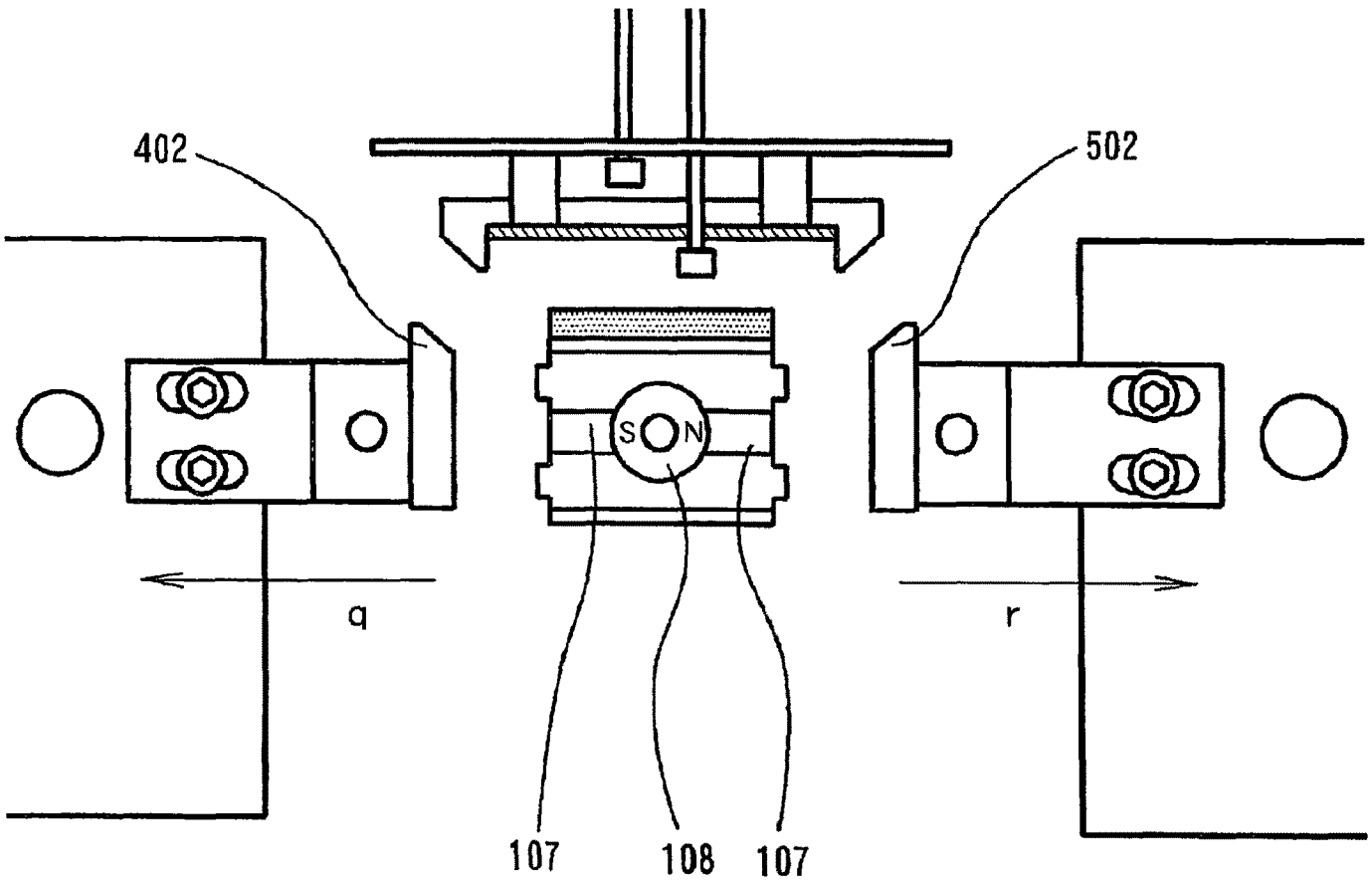
FIG. 20 is an explanatory drawing illustrating the operation of opening the sliding door in the lock device.

The sliding doors 200, 300 are then manually opened. Because the magnetic circuits for unlocking are thus provided instead of the magnetic circuits for locking, the locking portions 402, 502 are separated from the lock device 100 even by a very small force. Then, as shown in FIG. 20, the locking portion 402 of the rail moving body 400 moves in the direction of arrow (q), and the locking portion 502 of the rail moving body 500 moves, in the direction of arrow (r). While the handle operation is performed, the lock is released. Where the handle is fixed with the stopper in the handle device 121, attachment and locking are not performed with the lock device 100 even if the sliding doors 200, 300 are manually closed again in this state.

Thus, simultaneously with lifting the latch 113, the magnetic circuit for locking is opened, strong attraction of the locking portions 402, 502 by the lock device 100 is released, and then the locking portions 402, 502 can be easily separated. In this case, too, practically no mechanical resistance is applied to the latch 113 due to the gap (d) formed by the protruding portions 113*a*, 113*b* of the latch 113 and the protruding portions 402*a*, 502*a* of the locking portions 402, 502. As a result, the lifting operation can be performed smoothly by a small force.

Thus, during unlocking, as the latch 113 is lifted, the locking portions 402, 502 are released from being fixed by the lock device 100 and, therefore, the opening operation can be performed at a high speed by a small force.

Where the handle of the handle device 121 is returned to the original position, pulling of the inner wire 119 is released, but because the columnar permanent magnet 108 forms the magnetic circuits for unlocking, the latch 113 is held in the lifted position and the unlocked state is assumed. Therefore, the sliding doors 200, 300 can be manually closed, but once they are closed, they are locked and attached and the locked state is assumed.

The sliding door opening/closing device in accordance with the present invention is described above. The advantages of the sliding door opening/closing, device over the conventional configuration are described below.

In the sliding door opening/closing device in accordance with the present invention, where the locking portions of the sliding doors abut against the lock device, the locking portions are attached, locking is simultaneously performed, and the sliding doors are locked. In particular because the magnetic circuit for locking is characterized in that the attachment force greatly increases as the locking portions approach the magnetic lock device, the attachment force is greatly increased over that of the conventional system, the left and right door edge rubber is sufficiently crushed, the door gap is eliminated, and the occurrence of a state in which the latch cannot be lowered is avoided. In addition, locking can be conducted even if the resistance caused by the crushing amount of the door edge rubber and the resistance of the damping part that has a soundproofing function, a wind-stopping function, and a vibration damping function increase. The resistance force also can be regulated by adjusting the attachment position of the moving rail and arms with a screw unit.

Further, where an obstacle is clamped between the sliding doors, because the locking portions are prevented from contact with the magnetic lock device, the magnetic circuit for locking is not formed and the columnar permanent magnet does not move. Therefore, the latch cannot be lowered and locking is not performed. Therefore, door clamping detection accuracy is greatly increased. As a result, the problem of tradeoff between the locking and the door clamping detection that is inherent to conventional configurations is resolved.

No mechanical restraint is used to prevent movement as in conventional door lock devices, and positioning is performed in a location in which a tiny gap is opened at a path of the magnetically attached locking portions. Therefore, mechanical contact is reduced and locking and unlocking can be performed quietly by a small force, while attaining the object of preventing the sliding doors from opening. In addition, the conventional configuration uses a spring for lifting the latch, but in accordance with the present invention, the latch is lowered by a magnetic force created by the formation of magnetic circuit for locking and the latch is lifted by a magnetic force by the formation of magnetic circuit for unlocking. Therefore, noise can be reduced. Further, when the latch is lowered, it is positioned by contact with the elastic body. Therefore, noise can be further reduced.

The load applied to the latch during locking is created only by magnetic forces of the magnetic circuit during locking, and this load does not act as a counterforce for the sliding doors. Therefore, the outer wire is prevented from being deformed even by manual handle operation during emergency, and the situation in which the inner wire is extended above the specified limit, the relative pull-in amount of the inner wire is insufficient, and unlocking can be performed, as in the conventional configuration, can be avoided.

Attachment is possible even if the door inertia force created by the door closing speed is zero. Therefore, noise of collision during locking can be reduced.

During unlocking, the latch may be lifted by a force exceeding the couple of forces created by the formation of magnetic circuit for locking, and the effect of door repulsive force is eliminated. Therefore, the unlocking force may be small and therefore a small-size actuator serving as a separate installation can be used. As a result, metal contact noise during unlocking can be reduced.

The invention can be used for opening and closing sliding doors of vehicles such as trains and streetcars.

It will be appreciated by those skilled in the art that variations and modifications are possible, and that the invention may be practiced otherwise than as specifically described herein without departing from the scope of the invention.

What is claimed is:

1. A sliding door opening/closing device for a vehicle comprising:

at least one sliding door rail attached to a vehicle body;

at least two rail moving bodies configured to move along the sliding door rail;

two sliding doors that are attached to the respective two rail moving bodies;

an opening/closing drive device configured to supply an opening/closing drive force to drive the two sliding doors in an opening/closing direction along the sliding door rail;

two locking portions formed by magnetic bodies and provided at the two rail moving bodies opposite each other;

a magnetic lock device in which a columnar permanent magnet is rotatably supported; and a latch lifting lock device comprising a latch and a conversion unit configured to convert a rotational operation of the columnar permanent magnet of the magnetic lock device into a lifting operation of the latch and vice versa, wherein one of the locking portions, the magnetic lock device, and the other of the locking portions are disposed side by side along the sliding door rail, in an unlocked state in which the two sliding doors are opened and the two locking portions are separated from each side of the magnetic lock device, the magnetic lock device is configured to rotate and fix the columnar permanent magnet so as to form therein an unlocking magnetic circuit, and the latch lifting lock device is configured to fix the latch in a lifted position in response to fixing of the columnar permanent magnet, and in a locked state in which the two sliding doors are closed and the two locking portions abut against each side of the magnetic lock device, the magnetic lock device is configured to attract and fix the two locking portions by a magnetic force, while rotating and fixing the columnar permanent magnet, so as to form therein a locking magnetic circuit to lock together with the two locking portions that abut against both sides, and the latch lifting lock device is configured to fix the latch in a lowered position in response to the fixing of the columnar permanent magnet, while restraining the two locking portions to prevent them from separating from the magnetic lock device, using the lowered latch.

2. The sliding door opening/closing device for a vehicle according to claim 1, wherein in the unlocked state, a lowering force created by a weight of the lifted latch is converted by the conversion unit to an initial rotation force and applied to the columnar permanent magnet of the magnetic lock device to cause rotation thereof.

3. The sliding door opening/closing device for a vehicle according to claim 2, wherein in the unlocked state, the columnar permanent magnet of the magnetic lock device is fixed by a fixing force that exceeds the initial rotation force and is applied by the unlocking magnetic circuit, and the latch lifting lock device maintains the lifted position of the latch.

4. The sliding door opening/closing device for a vehicle according to claim 1, wherein when a transition is made from the unlocked state to the locked state, the magnetic lock device rotates the columnar permanent magnet while applying a rotation force thereto so as to form therein the locking magnetic circuit, and to attract and fix the two locking portions by a magnetic force at the same time as the formation of the locking magnetic circuit, and the latch lifting lock device converts the rotation force of the columnar permanent magnet into the lowering force of the latch, and restrains the two locking portions and the magnetic lock device by the lowered latch.

5. The sliding door opening/closing device for a vehicle according to claim 1, wherein the latch lifting lock device further comprises an actuator configured to perform an operation of lifting the latch, and when a transition is made from the locked state to the unlocked state, the actuator lifts the latch and cancels the restraint of the two locking portions created by the latch, and the conversion unit converts the lifting force of the latch into a rotation force of the columnar permanent magnet, to open the locking magnetic circuit and cancel the restraint of the two locking portions created by the magnetic attraction.

6. The sliding door opening/closing device for a vehicle according to claim 1, wherein the latch lifting lock device further comprises a wire device configured to perform an operation of lifting the latch by an inner wire, and when a transition is made from the locked state to the unlocked state, the wire device lifts the latch and cancels the restraint of the two locking portions created by the latch, and the conversion unit converts the lifting force of the latch into a rotation force of the columnar permanent magnet, to open the locking magnetic circuit and cancel the restraint of the two locking portions created by the magnetic attraction.

7. The sliding door opening/closing device for a vehicle according to claim 6, further comprising a handle device configured to move the inner wire of the wire device.

8. The sliding door opening/closing device for a vehicle according to claim 7, wherein the handle device is provided with a stopper that prevents the inner wire from moving, and as long as the inner wire is fixed by the stopper in the lifted position of the latch, the latch is prevented from being lowered by the latch lifting lock device, the locking magnetic circuit is prevented from being formed by rotation of the columnar permanent magnet of the magnetic lock device, and the two sliding doors are enabled to be opened and closed manually.

9. The sliding door opening/closing device for a vehicle according to claim 8, wherein when the restraint of the latch is canceled by operating the handle device, the lifted position of the latch is held by the unlocking magnetic circuit, and upon closing the two sliding doors manually, the locking magnetic circuit is formed and locking is performed.

10. The sliding door opening/closing device for a vehicle according to claim 1, wherein the conversion unit of the latch lifting lock device comprises:

a pinion attached so as to be coaxial with a rotation shaft of the columnar permanent magnet of the magnetic lock device;

a rack attached so as to mesh with the pinion and form a pitch line that is parallel to a lifting direction of the latch;

a slide rail that is attached so as to form a slide direction parallel to the lifting direction of the latch; and a lifting base that is supported so as to slide by the slide rail and to which the rack is fixed for lifting drive.

11. The sliding door opening/closing device for a vehicle according to claim 1, wherein the magnetic lock device comprises a magnetic circuit mechanism including a nonmagnetic body and upper and lower iron yokes sandwiching the nonmagnetic body, and having formed therein a hole that passes through the nonmagnetic body and the upper and lower iron yokes, the columnar permanent magnet in which an outer circumferential surface is magnetized to form two poles, namely, an N pole and an S pole, and is supported so as to rotate inside the hole of the magnetic circuit mechanism, wherein:

when the two locking portions are withdrawn from the magnetic circuit mechanism, a first part of the unlocking magnetic circuit is formed by the columnar permanent magnet and the upper iron yoke, and a second part of the unlocking magnetic circuit is formed by the columnar permanent magnet and the lower iron yoke, to stop the rotation of the columnar permanent magnet and fix the latch, and when the two locking portions abut against the magnetic circuit mechanism, the columnar permanent magnet is rotated, the locking magnetic circuit is formed by the columnar permanent magnet, the upper and lower iron yokes, and the two locking portions, and the two locking portions are configured to be attracted and fixed by a magnetic force.

12. The sliding door opening/closing device for a vehicle according to claim 1, wherein the opening/closing drive device comprises:

a body having two substantially parallel surfaces;

two sliding door drive racks that are movably attached so that teeth of the racks face each other on the two substantially parallel surfaces;

a sliding door drive pinion configured to mesh with the two drive racks; and a linear motor of which a moving member is connected to one sliding door drive rack from among the two sliding door drive racks and which is configured to move the one sliding door drive rack horizontally, and wherein the linear motor is configured to supply an opening/closing drive force to a first one of the sliding door drive racks, to supply an opening/closing drive force in a first direction to a first one of the sliding doors, and to rotate the sliding door drive pinion, and a second sliding door drive rack from among the two sliding door drive racks is configured to supply an opening/closing drive force in a second direction to the second sliding door.

13. The sliding door opening/closing device for a vehicle according to claim 1, wherein the opening/closing drive device comprises:

a body having two substantially parallel surfaces;

two sliding door drive racks that are movably attached so that teeth of the racks face each other on the two substantially parallel surfaces of the body;

a sliding door drive pinion that meshes with the two drive racks; and a sliding door drive motor configured to rotationally drive the drive pinion, and wherein the sliding door drive motor is configured to rotationally drive the sliding door drive pinion, to thereby supply an opening/closing drive force to a first sliding door drive rack from among the two sliding door drive racks, and to supply an opening/closing drive force in a first direction to the first sliding door, and a second sliding door drive rack from among the two sliding door drive racks is configured to supply an opening/closing drive force in a second direction to the second sliding door.

* * * * *